US008955962B2

(12) United States Patent
Maeyama et al.

(10) Patent No.: US 8,955,962 B2
(45) **Date of Patent: *Feb. 17, 2015**

(54) IMAGE FORMING APPARATUS INCLUDING SHEET CUTTING DEVICE

(75) Inventors: Yuichiro Maeyama, Kanagawa (JP); Kazuhiro Wakamatsu, Kanagawa (JP); Masahiko Yamada, Tokyo (JP); Masato Ogawa, Kanagawa (JP); Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 536 days.

This patent is subject to a terminal disclaimer.

(21) Appl. No.: 13/352,591

(22) Filed: Jan. 18, 2012

(65) Prior Publication Data

US 2012/0210838 A1 Aug. 23, 2012

(30) Foreign Application Priority Data

Feb. 17, 2011 (JP) ..... 2011-032239

(51) Int. Cl.
*B41J 2/165* (2006.01)
*B26D 1/24* (2006.01)
*B26D 7/00* (2006.01)

(52) U.S. Cl.
CPC ..... *B26D 1/245* (2013.01); *B26D 2007/005* (2013.01)
USPC ..... 347/104

(58) Field of Classification Search
None
See application file for complete search history.

(56) References Cited

U.S. PATENT DOCUMENTS

2011/0064497 A1 3/2011 Niihara et al.
2011/0211210 A1 9/2011 Niihara et al.
2013/0095990 A1* 4/2013 Maeyama et al. ..... 493/31

FOREIGN PATENT DOCUMENTS

JP 2002-326412 11/2002
JP 2005-199606 7/2005
JP 2009/214200 9/2009

OTHER PUBLICATIONS

U.S. Appl. No. 13/293,517, filed Nov. 10, 2011.
U.S. Appl. No. 13/306,029, filed Nov. 29, 2011.
U.S. Appl. No. 13/307,157, filed Nov. 30, 2011.

* cited by examiner

*Primary Examiner* — Alejandro Valencia
(74) *Attorney, Agent, or Firm* — Cooper & Dunham LLP

(57) ABSTRACT

An image forming apparatus includes a recording head, a carriage, a sheet cutting device, a cutter position detecting device, and a notification device. The carriage mounts the recording head and is reciprocally movable in a width direction of a sheet perpendicular to a sheet feed direction. The sheet cutting device includes a cutter and a cutter holder. A movement area of the carriage overlaps, in a thickness direction of the sheet, a movement area of the cutter holder in which the cutter holder moves to cut the sheet with the cutter. The cutter holder, after cutting the sheet, is movable in the width direction of the sheet with the cutter holder being retracted from the sheet feed path in the thickness direction of the sheet. The notification device notifies a user of an abnormality of the cutter holder based on a detection result of the cutter position detecting device.

15 Claims, 14 Drawing Sheets

IMAGE FORMING APPARATUS INCLUDING SHEET CUTTING DEVICE

CROSS-REFERENCE TO RELATED APPLICATION

This patent application is based on and claims priority pursuant to 35 U.S.C. §119 to Japanese Patent Application No. 2011-032239, filed on Feb. 17, 2011, in the Japan Patent Office, the entire disclosure of which is hereby incorporated by reference herein.

BACKGROUND

1. Technical Field

This disclosure relates to an image forming apparatus, and more specifically to an image forming apparatus including a sheet cutting device to cut a rolled sheet to a desired length.

2. Description of the Related Art

Image forming apparatuses are used as printers, facsimile machines, copiers, plotters, or multi-functional devices having two or more of the foregoing capabilities. As a conventional type of image forming apparatus, an image forming apparatus is known that feeds a long-size rolled sheet (hereinafter, rolled sheet) in a certain feed direction (hereinafter, sheet feed direction) to form an image on the rolled sheet. The image forming apparatus typically has a sheet cutting device to cut the rolled sheet to a desired length by moving a cutter in a direction perpendicular to the sheet feed direction (hereinafter, width direction).

Such a conventional sheet cutting device needs to return a cutter holder holding the cutter to an initial position (home position) in preparation for the next sheet cutting. At this time, if a forward path along which the cutter moves to cut the sheet is identical to a backward path along which the cutter moves to return to the home position, the cutter contacts the already-cut sheet on the backward path, thus hampering movement of the cutter holder (so-called "cut jam") or causing other failure.

To prevent such a cut jam or other failure, for example, JP-2009-214200-A proposes an image forming apparatus including a sheet cutting device in which the backward path of the cutter formed with the pair of circular blades differs from the forward path of the cutter. Relative to the forward path, the backward path is arranged at a downstream side in the sheet feed direction in which the sheet is fed along a sheet feed path and at a position away from a leading edge of a subsequent divided sheet upstream from the cutter in the sheet feed direction.

Specifically, after the cutter finishes the cutting operation, the cutter holder is tilted toward the downstream side in the sheet feed direction around a guide member for guiding the movement of the cutter holder. Thus, the position of the cutter moving along the backward path in the sheet feed direction is shifted to the downstream side in the sheet feed direction relative to the position of the cutter moving along the forward path. Such a configuration can prevent the cutter from contacting the subsequent divided sheet on the backward path, thus preventing a cut jam.

However, in the image forming apparatus described in JP-2009-214200-A, the cutter holder and the carriage holding the recording head are arranged independently of each other and in tandem in the sheet feed direction. As a result, the width of the image forming apparatus in the sheet feed direction is relatively large, thus resulting in an increased size of the image forming apparatus. As described above, in the image forming apparatus, the forward path of the cutter differs from the backward path, thus preventing the cutter from contacting the subsequent divided sheet on the backward path. However, the cutter holder still remains on the sheet feed path after cutting operation. As a result, the subsequent sheet cannot be fed from the rolled sheet until the cutter and the cutter holder return to the home position, thus hampering gains in productivity.

Hence, to enhance productivity while providing a compact apparatus main unit, the inventors of the present patent application have conceived an image forming apparatus having the following configuration. In the image forming apparatus, the carriage is arranged to overlap the cutter holder in a thickness direction of a rolled sheet to reduce the width of the apparatus main unit in the sheet feed direction. Additionally, relative to the forward path, the backward path is arranged so as to be retracted from the sheet feed path in the thickness direction of the rolled sheet. Thus, after the cutting of the rolled sheet, the cutter holder is movable along the backward path with the cutter holder retracted from the sheet feed path.

Such a configuration can reduce the width of the apparatus main unit, thus allowing the inkjet recording apparatus 1 to be more compact. Additionally, because the cutter holder is movable along the backward path with the cutter holder retracted from the sheet feed path, a subsequent portion of the rolled sheet can be fed while the cutter holder moves along the backward path, thus enhancing productivity.

However, in the image forming apparatus having such a configuration, because the carriage is arranged to overlap the cutter holder in the vertical direction, a movement area of the carriage in the sheet width direction (the main scanning direction) overlaps a movement area of the cutter holder along the forward path. In other words, if the cutter holder moves during movement of the carriage or the carriage moves during movement of the cutter holder, the carriage would interfere with the cutter holder. As a result, for example, if the cutter holder is abnormally stopped on the forward path, the carriage cannot be moved, thus hampering movement of the carriage to a capping position which is located at one end of the movement area of the carriage. Consequently, the nozzle faces of the recording heads might dry, thus causing an ink ejection failure or damage to the recording heads.

BRIEF SUMMARY

In an aspect of this disclosure, there is provided an image forming apparatus including a recording head, a carriage, a sheet cutting device, a cutter position detecting device, and a notification device. The recording head ejects ink onto a sheet of recording media fed along a sheet feed path. The carriage mounts the recording head and is reciprocally movable in a width direction of the sheet to record an image on the sheet on the sheet feed path with the recording head. The width direction of the sheet is perpendicular to a sheet feed direction in which the sheet is fed along the sheet feed path. The sheet cutting device includes a cutter to cut the sheet to a desired length and a cutter holder holding the cutter. The cutter holder is movable in the width direction of the sheet. A movement area of the carriage overlaps, in a thickness direction of the sheet, a movement area of the cutter holder in which the cutter holder moves to cut the sheet with the cutter. The cutter position detecting device detects a position of the cutter holder. The notification device notifies a user of an abnormality of the cutter holder. The cutter holder, after cutting the sheet with the cutter, is movable in the sheet width direction with the cutter holder being retracted from the sheet feed path in the thickness direction of the sheet. The notification device notifies the user of the abnormality of the cutter holder based on a detection result of the cutter position detecting device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
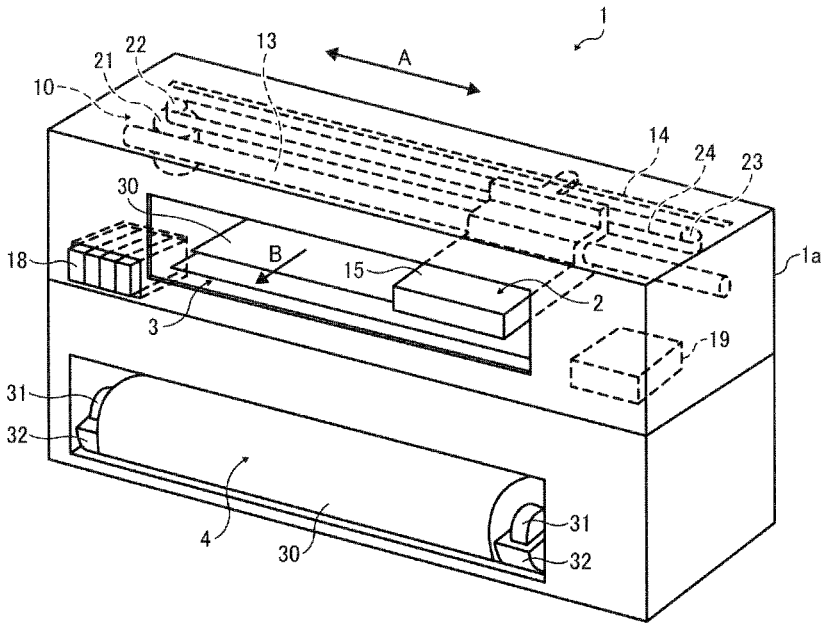
FIG. 1 is a schematic perspective view of an inkjet recording apparatus according to a first exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First Exemplary Embodiment

FIGS. 1 to 14 show an image forming apparatus according to a first exemplary embodiment of the present disclosure. In FIGS. 1 to 14, an inkjet recording apparatus is illustrated as an example of the image forming apparatus.

Figure 2:
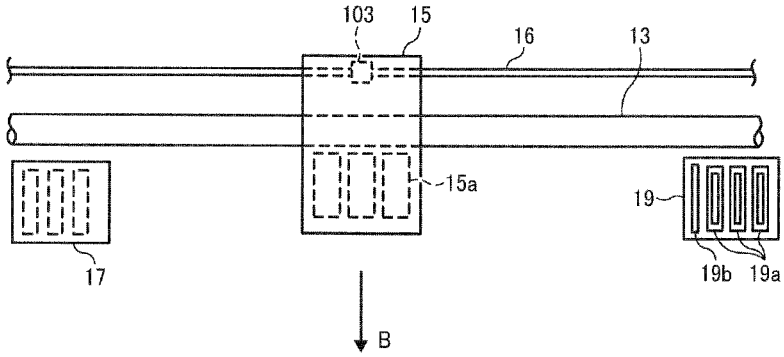
FIG. 2 is a schematic plan view of a carriage and a portion of the inkjet recording apparatus illustrated in FIG. 1.

In FIGS. 1 and 2, an inkjet recording apparatus 1 serving as the image forming apparatus is a serial-type inkjet recording apparatus that moves an inkjet recording head in a width direction (hereinafter, sheet width direction) of a sheet for scanning to form an image on the sheet. After one or more scans are performed to form a line of the image, the inkjet recording apparatus 1 feeds the sheet forward a certain distance to form another line of the image.

Figure 12:
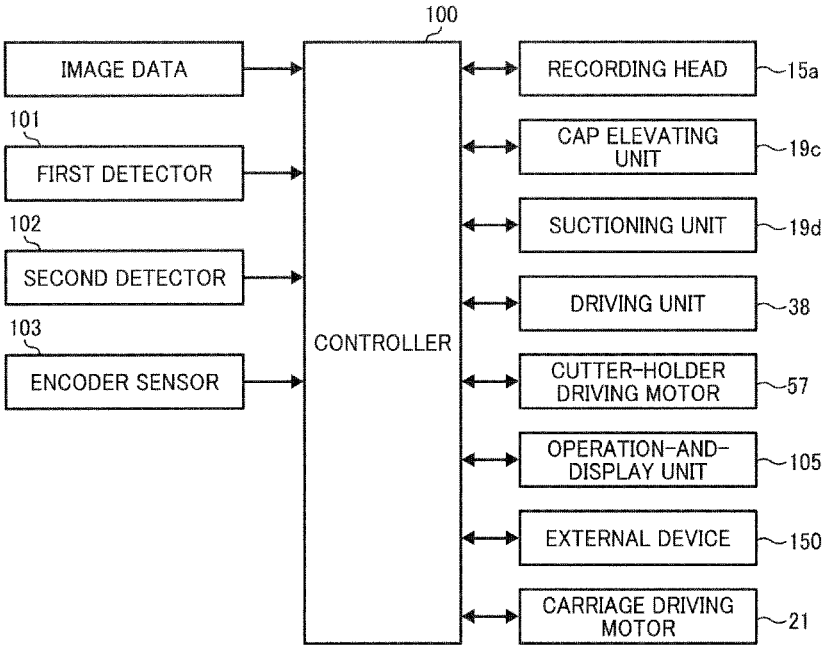
FIG. 12 is a schematic block diagram of a control configuration of the inkjet recording apparatus according to the first exemplary embodiment.

The inkjet recording apparatus 1 includes an image forming section 2 serving as an image forming device, a sheet feed section 3, a rolled sheet storage section 4, a sheet cutting device 5, and a controller 100 (see FIG. 12). The image forming section 2, the sheet feed section 3, the rolled sheet storage section 4, the sheet cutting device 5, and the controller 100 are disposed within an apparatus main unit 1*a*.

In the image forming section 2, a guide rod 13 and a guide rail 14 extend between side plates, and a carriage 15 is supported by the guide rod 13 and the guide rail 14 so as to be slidable in a direction indicated by an arrow A in FIG. 1.

The carriage 15 holds recording heads 15*a* (see FIG. 2) to eject ink droplets of, e.g., black (K), yellow (Y), magenta (M), and cyan (C). Sub tanks are integrally molded with the corresponding recording heads 15*a* to supply color inks to the respective recording heads 15*a*.

Figure 13:
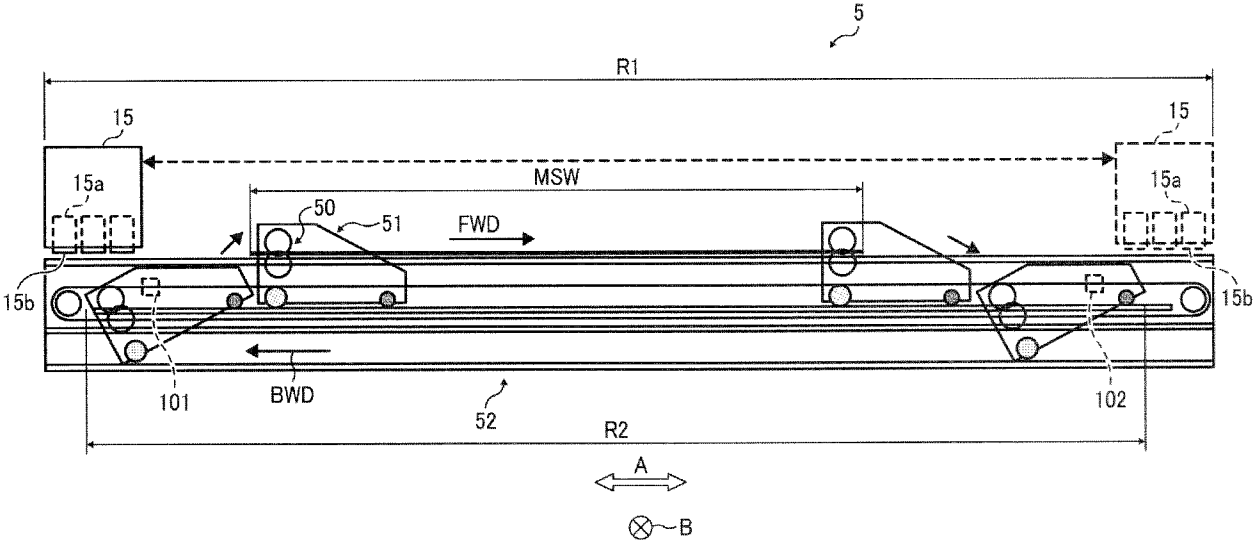
FIG. 13 is a schematic view of ranges of movement of the carriage and the cutter holder.

A main scanning mechanism 10 moves the carriage 15 for scanning in a main scanning direction, that is, the sheet width direction indicated by the arrow A. Specifically, as illustrated in FIG. 13, the carriage 15 is movable in the sheet width direction between a carriage home position (indicated by a solid line in FIG. 13) and a maintenance ejection position (indicated by a broken line in FIG. 13). The carriage home position and the maintenance ejection position of the carriage 15 are disposed away from each other in the sheet width direction outside a range of a maximum sheet width MSW. Hereinafter, the range of movement of the carriage 15 in the sheet width direction (indicated by an arrow R1 in FIG. 13) may be referred to as "carriage movement range". Each of the maintenance ejection position and the carriage home position is located at a retreat position outside an area in which a cutter holder 51 moves. The maintenance ejection position and the carriage home position are collectively referred to as cutting standby positions. In this exemplary embodiment, the carriage home position corresponds to a first standby position, and the maintenance ejection position corresponds to a second standby position.

As illustrated in FIG. 1, the main scanning mechanism 10 includes a carriage driving motor 21 disposed at a first end in the sheet width direction, a driving pulley 22 rotated by the carriage driving motor 21, a driven pulley 23 disposed at a second end opposite the first end in the sheet width direction, and a belt member 24 looped around the driving pulley 22 and the driven pulley 23. A tension spring tensions the driven pulley 23 outward, that is, away from the driving pulley 22. A portion of the belt member 24 is fixed to and held by a belt fixing portion at a rear side of the carriage 15 to draw the carriage 15 in the sheet width direction.

To detect a main scanning position of the carriage 15 in the main scanning direction, as illustrated in FIG. 2, an encoder sheet 16 is disposed along the sheet width direction in which the carriage 15 moves. An encoder sensor 103 disposed at the carriage 15 reads the encoder sheet 16 to detect the main scanning position of the carriage 15.

As illustrated in FIGS. 1 and 2, in a recording area of a main scanning region (movement range R1) of the carriage 15, a rolled sheet 30 is intermittently fed by the sheet feed section 3 in a direction perpendicular to the sheet width direction, that is, the sheet feed direction indicated by an arrow B in FIGS. 1 and 2.

Outside the movement range R1 of the carriage 15 in the sheet width direction or at a side proximal to a first end of the main scanning region of the carriage 15, main cartridges 18 are removably mounted to the apparatus main unit 1*a* to store the respective color inks to be supplied to the sub tanks of the recording heads 15*a*. Additionally, as illustrated in FIG. 2, at a first side proximal to the maintenance ejection position of the carriage movement range R1 (left side in FIG. 2), a droplet receptacle 17 is disposed to store ink droplets not used for a recorded image but ejected for discharging viscosity-increased ink during maintenance ejection. Under certain conditions, the recording heads 15*a* perform the maintenance ejection at the maintenance ejection position to maintain and recover desired ejection performance.

At a second side proximal to the carriage home position of the carriage movement range R1 (right side in FIG. 2), a capping position is located at which a maintenance unit 19 is disposed to maintain and recover conditions of the recording heads 15*a*. The maintenance unit 19 includes, e.g., caps 19*a* to cap respective nozzle faces 15*b* (see FIG. 4) of the recording heads 15, a wiper blade 19*b* serving as a blade member to wipe the nozzle faces 15*b*, a cap elevating unit 19*c* (see FIG. 12) to move the caps 19*a* and the wiper blade 19*b* up and down, and suctioning units 19*d* (see FIG. 12) connected to the caps 19*a* to suction the nozzle faces 15*b* with the nozzle faces 15*b* capped with the caps 19*a*.

For example, after printing operation or on detection of an abnormality of the cutter holder, the cap elevating unit 19*c* is driven to cap the nozzle faces 15*b* with the caps 19*a*. When the suctioning units 19*d* are activated with the nozzle faces 15*b* capped with the caps 19*a*, the internal space of each of the caps 19*a* is turned into a negative pressure, thus allowing ink to be discharged from the nozzles into the caps 19*a*. The discharged waste ink is drained into a waste-liquid tank.

In this exemplary embodiment, the caps 19*a* and the cap elevating unit 19*c* serve as a capping device. Alternatively, for example, the droplet receptacle may be disposed at the side proximal to the carriage home position and included in the maintenance unit 19 with the caps 19*a* and the wiper blade 19*b*. Furthermore, two droplet receptacles may be disposed at the carriage-home-position side and the maintenance-ejection-position side.

The rolled sheet storage section 4 serves as a sheet feed unit into which the rolled sheet 30 serving as a sheet material for image recording is set. As the rolled sheet 30, rolled sheets of different widths can be set to the rolled sheet storage section 4. The rolled sheet 30 includes a sheet shaft, and flanges 31 are mounted at opposed ends of the sheet shaft. By mounting the flanges 31 to flange bearings 32 of the rolled sheet storage section 4, the rolled sheet 30 is stored in the rolled sheet storage section 4. The flange bearings 32 include support rollers to rotate the flanges 31 while contacting the outer circumference of the flanges 31 to feed the rolled sheet 30 to the sheet feed path.

Figure 3:
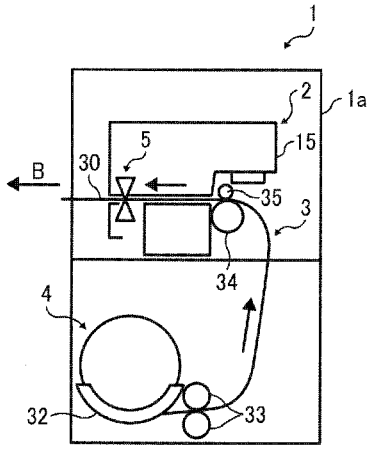
FIG. 3 is a schematic side view of the inkjet recording apparatus illustrated in FIG. 1.

As illustrated in FIG. 3, the sheet feed section 3 includes a pair of sheet feed rollers 33, a registration roller 34, a registration pressing roller 35, and a driving unit 38. The driving unit 38 (see FIG. 12) includes, for example, a driving motor to drive the pair of sheet feed rollers 33, the registration roller 34, and the registration pressing roller 35. The pair of sheet feed rollers 33 feeds the rolled sheet 30 from the rolled sheet storage section 4 to the sheet feed path. The registration roller 34 and the registration pressing roller 35 are disposed upstream from the image forming section 2 in the sheet feed direction to feed the rolled sheet 30 to the sheet cutting device 5 via the image forming section 2.

After the rolled sheet 30 is fed from the rolled sheet storage section 4, the sheet feed section 3 feeds the rolled sheet 30 forward (toward the left side in FIG. 3) from the rear side (right side in FIG. 3) of the apparatus main unit 1*a* to the recording area below the image forming section 2. When the rolled sheet 30 is fed to the recording area, the carriage 15 reciprocally moves back and forth in the sheet width direction and the recording heads 15*a* eject ink droplets in accordance with image information. In addition, while the rolled sheet 30 is intermittently fed forward, the recording heads 15*a* repeatedly eject ink droplets onto the rolled sheet 30 to record lines of a desired image on the rolled sheet 30. Thus, the whole image is formed on the rolled sheet 30 in accordance with the image information.

After image formation, the sheet cutting device 5 cuts the rolled sheet 30 to a desired length, and the cut sheet is discharged to a sheet output tray at the front side of the apparatus main unit 1*a*.

Next, the sheet cutting device 5 in this exemplary embodiment is described with reference to FIGS. 4 to 8.

Figure 4:
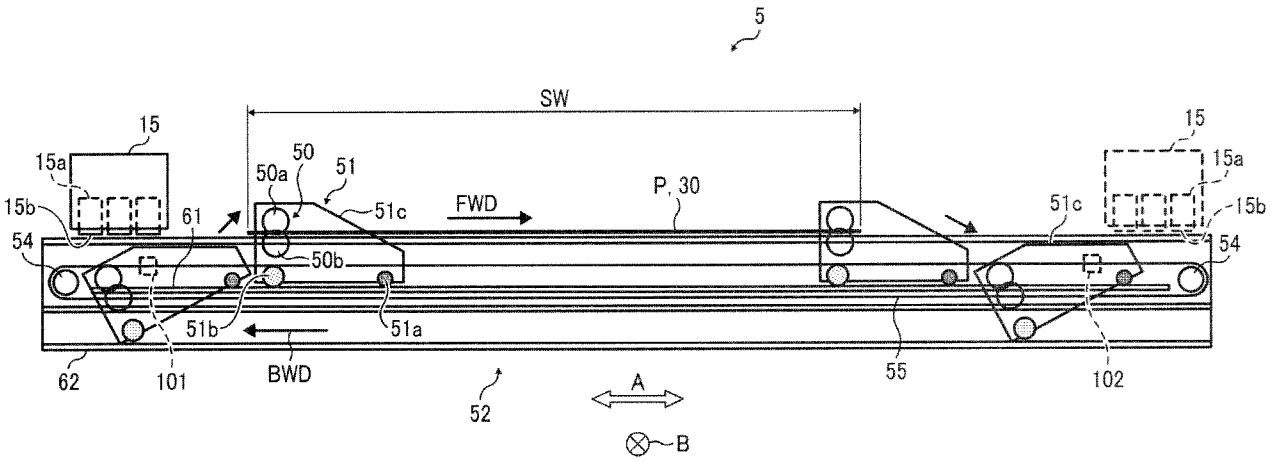
FIG. 4 is a schematic back view of a sheet cutting device of the inkjet recording apparatus illustrated in FIG. 1.

FIG. 4 is a schematic view of the sheet cutting device 5 seen from the back side of the apparatus main unit 1*a*. The sheet cutting device 5 is disposed downstream from the image forming section 2 in the sheet feed direction (see FIG. 3) and has a cutter 50, a cutter holder 51, and a guide member 52 as illustrated in FIG. 4.

The cutter 50 is formed with circular blades 50*a* and 50*b*. The circular blades 50*a* and 50*b* are disposed opposing each other and rotatably held by the cutter holder 51. With movement of the cutter holder 51 in the sheet width direction indicated by the arrow A in FIG. 4, the circular blades 50*a* and 50*b* obtain a driving force to rotate. In other words, the cutter 50 rotates the circular blades 50*a* and 50*b* to cut the rolled sheet 30, and thus is capable of cutting, e.g., a relatively thick rolled sheet. Additionally, the cutter 50 is formed with the circular blades, thus preventing a failure, such as uneven wearing of a particular portion as in a stationary blade. It is to be noted that the number of circular blades of the cutter 50 is not limited to two and may be three or more. Additionally, the configuration of the cutter 50 is not limited to the pair of the circular blades 50*a* and 50*b* in this exemplary embodiment. For example, the cutter may have a pair of one circular blade and one fixed blade.

The cutter holder 51 is reciprocally movable back and forth within a range of movement in the sheet width direction (hereinafter may be referred to as "cutter-holder movement range") indicated by an arrow R2 in FIG. 13. A first retracted position (left side in FIG. 13) and a second retracted position (right side in FIG. 13) of the cutter holder 51 are disposed at opposed ends of the cutter-holder movement range R2. At the first and second retracted positions, the cutter holder 51 is retracted from the sheet feed path downward in a thickness direction of the rolled sheet 30 (hereinafter, sheet thickness direction), that is, the vertical direction, thus preventing the cutter holder 51 from interfering with the carriage 15 at the first and second retracted positions. In this exemplary embodiment, the first retracted position corresponds to a home position of the cutter holder 51 (hereinafter, "cutter home position").

When the cutter holder 51 moves along a forward path (indicated by an arrow FWD in FIG. 4) from the second end side to the first end side of the apparatus main unit 1*a* (see FIG. 1), the cutter 50 cuts the rolled sheet 30. In other words, the cutter holder 51 moves from the cutter home position (the first retracted position) to the second retracted position while cutting the rolled sheet 30.

By contrast, when the cutter holder 51 moves along a backward path (indicated by an arrow BWD in FIG. 4) from the first end side to the second end side of the apparatus main unit 1*a* (see FIG. 1), the cutter holder 51 moves to the cutter home position at a state in which the cutter holder 51 is retracted from the sheet feed path downward in the vertical direction. As a result, on the backward path, the cutter holder 51 is separated from the sheet feed path (indicated by a solid line P in FIG. 4) so as not to block the sheet feed path.

At the opposed ends of the cutter-holder movement range R2, for example, a first detector 101 and a second detector 102, such as transmissive sensors or micro switches, are disposed to detect the cutter holder 51. The first detector 101 and the second detector 102 detect that the cutter holder 51 is placed at the first and second retracted positions, respectively. The controller 100 controls the cutter holder 51 based on the position of the cutter holder 51 detected with the first detector 101 and the second detector 102. In this exemplary embodiment, the first detector 101 and the second detector 102 serve as a cutter position detector.

A configuration of the cutter holder 51 is described below.

The cutter holder 51 has a driving roller 51*a* and a driven roller 51*b*, and holds the cutter 50 inside. The driving roller 51*a* is connected to a wire 55 extending between a pair of pulleys 54 at opposed ends of the apparatus main unit 1*a* in the sheet width direction. The wire 55 circulates in the sheet width direction via the pair of pulleys 54 rotated by a cutter-holder driving motor 57 (see FIG. 12). As a result, the driving roller 51*a*, while rotating, moves on an upper guide rail 61 with the circulation of the wire 55. The cutter holder 51 is movable in the sheet width direction with the movement of the driving roller 51*a*. The driven roller 51*b* is rotatably disposed away from the driving roller 51*a* in the sheet width direction. The driven roller 51*b* moves on the upper guide rail 61 along the forward path of the cutter holder 51 and on a lower guide rail 62 along the backward path. In other words, during the movement of the cutter holder 51, the driven roller 51*b* functions as a positioning member to position the cutter holder 51 with respect to the upper guide rail 61 and the lower guide rail 62. It is to be noted that the positioning member of the cutter holder 51 is not limited to the driven roller 51*b* but may be, for example, a circular-arc protrusion.

On switching the moving path between the forward path and the backward path, the cutter holder 51 pivots in the vertical direction around the driving roller 51*a*. Thus, the cutter holder 51 switches its position between a first position with which the cutter holder 51 cuts the rolled sheet 30 along the forward path and a second position with which the cutter holder 51 is retracted from the sheet feed path.

Figure 5A:
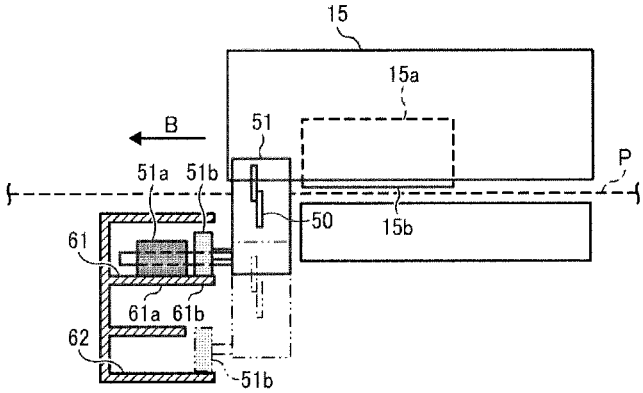
FIG. 5A is a partially cross-sectional side view of the sheet cutting device illustrated in FIG. 4.

As illustrated in FIG. 5A, the cutter holder 51 is disposed within the width of the carriage 15 in the sheet feed direction. In other words, the carriage 15 and the cutter holder 51 are arranged to overlap in the vertical direction so that the carriage movement range partially overlaps an area in which the cutter holder 51 moves along the forward path, thus reducing the width of the apparatus main unit 1*a* in the sheet feed direction. In the above-described arrangement of this exemplary embodiment, when the carriage 15 is placed at the carriage home position or the maintenance ejection position, the cutter holder 51 moves along the forward path, thus preventing the cutter holder 51 from interfering with the carriage 15. Such movement control of the cutter holder 51 is performed by the controller 100 as described below. In FIG. 5A, a broken line P extending in the direction indicated by the arrow B represents the sheet feed path.

The driving roller 51*a* and the driven roller 51*b* are offset from each other in the sheet feed direction indicated by the arrow B. Specifically, the driven roller 51*b* is arranged upstream from the driving roller 51*a* in the sheet feed direction. As a result, with the driving roller 51*a* held on the upper guide rail 61, the driven roller 51*b* is movable between the upper guide rail 61 and the lower guide rail 62, thus allowing the cutter holder 51 to pivot around the driving roller 51*a*.

As illustrated in FIG. 4, the cutter holder 51 has a slanted face 51*c* slanted at a predetermined angle from the sheet feed path (indicated by the solid line P) toward the vertical direction. The slant angle of the slanted face 51*c* is set so that the slanted face 51*c* is parallel to the sheet feed path when the cutter holder 51 moves along the backward path.

As illustrated in FIG. 4, the guide member 52 is a guide member to guide the movement of the cutter holder 51 in the sheet width direction, and includes the upper guide rail 61, extending in the sheet width direction for a length that is at least longer than the width (sheet feed width) of the sheet feed path indicated by an arrow SW, and the lower guide rail 62 disposed away from the sheet feed path downward in the vertical direction. The guide member 52 forms the forward path of the cutter holder 51 on the upper guide rail 61 and the backward path of the lower guide rail 62 on the lower guide rail 62. In this exemplary embodiment, the upper guide rail 61 and the lower guide rail 62 are formed as a single member (the guide member 52). Alternatively, the upper guide rail 61 and the lower guide rail 62 may be formed as separate members.

Figure 5B:
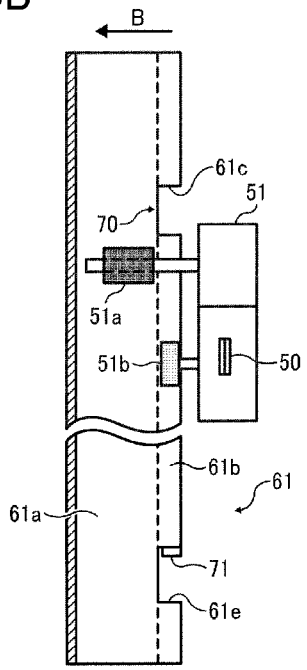
FIG. 5B is a partially cross-sectional plan view of the sheet cutting device illustrated in FIG. 4.

As illustrated in FIGS. 5A and 5B, the upper guide rail 61 has a driving-roller guide area 61*a* to guide the driving roller 51*a* in the sheet width direction and a driven-roller guide area 61*b* to guide the driven roller 51*b* so that the cutter holder 51 moves along the forward path. In this exemplary embodiment, the driving-roller guide area 61*a* and the driven-roller guide area 61*b* are formed as a single rail, that is, the upper guide rail 61. Alternatively, the driving-roller guide area 61*a* and the driven-roller guide area 61*b* may be formed as separate rails.

Figure 7:
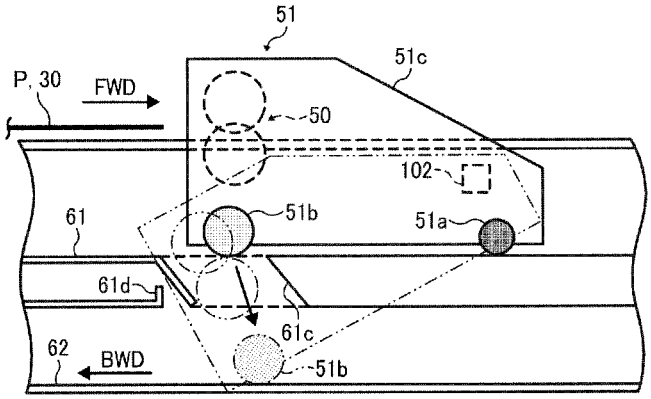
FIG. 7 is a schematic view of the cutter holder shifting to a backward path.

At a first end side of the driven-roller guide area 61*b* in the sheet width direction, a first connection path 61*c* is formed to switch the moving path of the cutter holder 51 from the forward path to the backward path. As illustrated in FIG. 7, the first connection path 61*c* is formed at the upper guide rail 61 so as to connect the forward path (indicated by an arrow FWD) on the upper guide rail 61 to the backward path (indicated by an arrow BWD) on the lower guide rail 62. Specifically, a predetermined portion of the upper guide rail 61 is cut out at the first end side in the sheet width direction and folded so as to slant downward at a certain angle, thus forming the first connection path 61*c*. Thus, the first connection path 61*c* allows the driven roller 51*b* to move from the upper guide rail 61 to the lower guide rail 62 after the rolled sheet is cut with the cutter 50. A lower end portion 61*d* of the upper guide rail 61 adjacent to the first connection path 61*c* is folded upward so as not to contact the driven roller 51*b* moving along the backward path.

Figure 6:
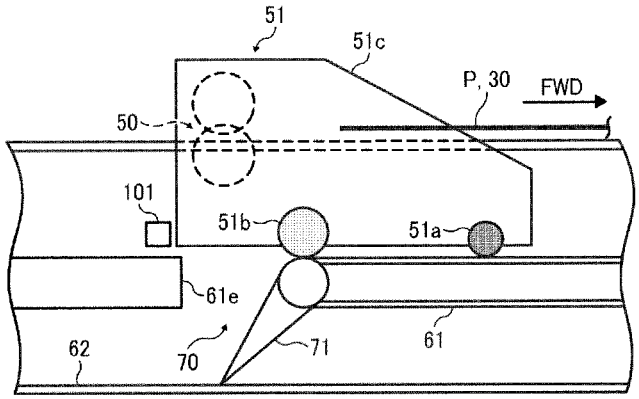
FIG. 6 is a schematic view of a cutter holder having returned to a rolled-sheet cutting area in the first exemplary embodiment.

As illustrated in FIG. 6, a moving mechanism 70 is disposed at a second end side of the driven-roller guide area 61*b* opposite the first end side in the sheet width direction. When the cutter holder 51 moves from the cutter home position indicated by a solid line in FIG. 10 to the opposite end in the sheet width direction, the moving mechanism 70 shifts the driven roller 51*b* from the lower guide rail 62 to the upper guide rail 61, that is, returns the cutter holder 51 to a cutting area (rolled-sheet cutting area) of the rolled sheet.

The moving mechanism 70 includes a second connection path 61*e* to connect the backward path on the lower guide rail 62 to the forward path on the upper guide rail 61, and a switching hook 71 disposed adjacent to the second connection path 61*e* at the upper guide rail 61.

The second connection path 61*e* is formed by cutting out a predetermined portion of the upper guide rail 61 at the second end side in the sheet width direction (see FIG. 5B).

Figure 10:
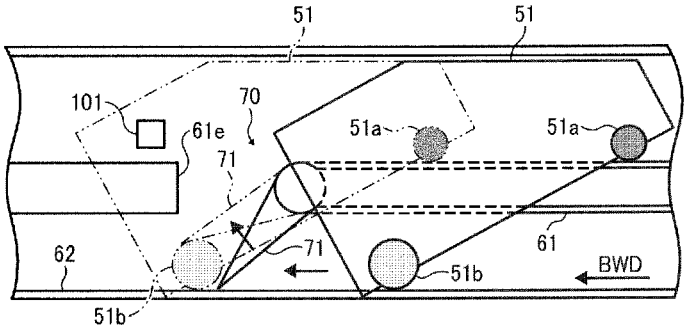
FIG. 10 is a schematic view of the cutter holder returning from the backward path to a home position.
Figure 11:
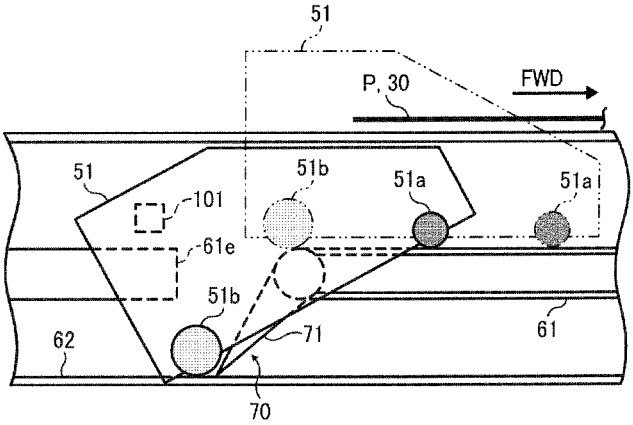
FIG. 11 is a schematic view of the cutter holder returning to a rolled-sheet cutting area.

The switching hook 71 pivots between the backward path and the second connection path 61*e* and is constantly urged downward by an urging member, e.g., a coil spring, so that a tip of the switching hook 71 contacts the lower guide rail 62. As a result, as illustrated in FIG. 10, when the cutter holder 71 moves along the backward path (indicated by an arrow BWD) to the second end side in the sheet width direction, the driven roller 51*b* contacts the switching hook 71 to pivot the switching hook 71 as indicated by a broken line. In this state, when the driven roller 51*b* further moves to the second end side in the sheet width direction, the switching hook 71 is separated from the driven roller 51*b* and returned by the urging member to an initial position, that is, a position indicated by a solid line in FIG. 10. At the initial position indicated by the solid line in FIG. 10, the switching hook 71 is tilted at a predetermined angle. Thus, as illustrated in FIG. 11, when the cutter holder 51 returns from the backward path to the forward path, the driven roller 51*b* can be moved from the lower guide rail 62 to the upper guide rail 61 via the switching hook 71. The switching hook 71 may be, for example, a leaf spring. In such a case, the urging member is not necessary.

The lower guide rail 62 guides the driven roller 51*b* of the cutter holder 51 moving along the backward path.

Next, operation of the sheet cutting device 5 is described with reference to FIGS. 6 to 11.

As illustrated in FIG. 11, before the rolled sheet 30 is cut, the cutter holder 51 is placed at the cutter home position (indicated by the solid line in FIG. 11) at the second end side in the sheet width direction. At this time, the first detector 101 is turned on, thus detecting that the cutter holder 51 is placed at the cutter home position. When an instruction for sheet cutting is received, the driving roller 51*a* is rotated via the wire 55 (see FIG. 4) to move the cutter holder 51. As a result, the cutter holder 51 moves from the cutter home position to the rolled-sheet cutting area (a position indicated by a broken line in FIG. 11), and the first detector 101 is turned off. Then, the cutter holder 51 moves along the forward path to the first end side in the sheet width direction. At this time, the cutter 50 cuts the rolled sheet 30 with the movement of the cutter holder 51.

Figure 8:
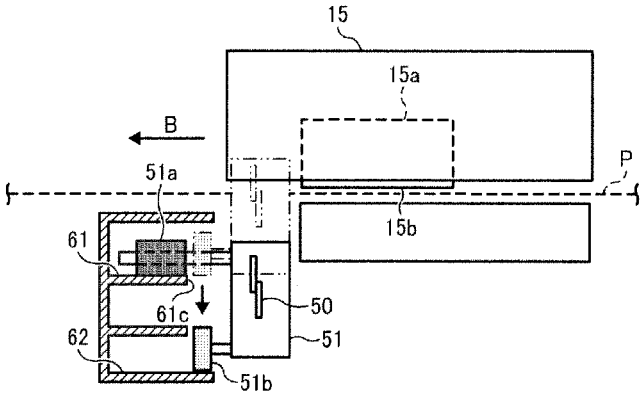
FIG. 8 is a partially cross-sectional side view of the sheet cutting device illustrated in FIG. 4 when the cutter holder shifts to the backward path.

Next, as illustrated in FIG. 7, when the cutter holder 51 moves along the forward path (indicated by an arrow FWD) to the first end side in the sheet width direction across the sheet feed path (indicated by a solid line P), the second detector 102 is turned on. Thus, by detecting the cutter holder 51 with the second detector 102, it is detected that the cutter holder 51 is placed at the second retracted position, and the cutting of the rolled sheet 30 ends. At this time, to switch the moving path of the cutter holder 51 from the forward path to the backward path, the cutter holder 51 pivots downward in the vertical direction around the driving roller 51*a* by its own weight. Specifically, when the driven roller 51*b* moving on the upper guide rail 61 arrives at the first connection path 61*c*, the driven roller 51*b* moves from the upper guide rail 61 to the lower guide rail 62 via the first connection path 61*c*. At this time, as illustrated in FIG. 8, with the driving roller 51*a* retained on the upper guide rail 61, only the driven roller 51*b* moves to the lower guide rail 62 by its own weight. As a result, in FIG. 7, the cutter holder 51 overlapping the sheet feed path indicated by a broken line P pivots to take a position with which the cutter holder 51 is movable along the backward path, that is, the position (indicated by a broken line in FIG. 7) with which the cutter holder 51 is retracted from the sheet feed path.

Figure 9:
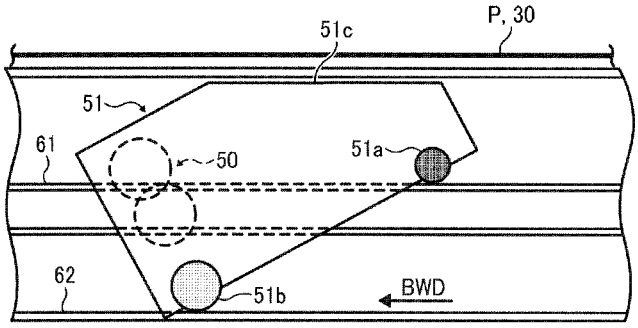
FIG. 9 is a schematic view of the cutter holder moving along the backward path.

Then, the wire 55 (see FIG. 4) is circulated in reverse to rotate the driving roller 51*a* in reverse, that is, in a direction opposite a direction in which the driving roller 51*a* rotates on the forward path. Thus, as illustrated in FIG. 9, with the position retracted from the sheet feed path indicated by the solid line P, the cutter holder 51 moves along the backward path (indicated by an arrow BWD) to the second end side in the sheet width direction. At this time, when the cutter holder 51 starts to move, the second detector 102 is turned off. On the backward path, the slanted face 51*c* is substantially parallel to the sheet feed path and, unlike on the forward path, the cutter holder 51 is retracted downward from the sheet feed path. Thus, even when the cutter holder 51 moves along the backward path, the rolled sheet 30 can be fed along the sheet feed path and the carriage 15 (see FIG. 4) is movable in the sheet width direction.

Next, as illustrated in FIG. 10, when the cutter holder 51 moves to the second end side in the sheet width direction and arrives at a position adjacent to the moving mechanism 70, the driven roller 51*b* contacts the switching hook 71. With the movement of the cutter holder 51, the driven roller 51*b* pushes up the switching hook 71 as indicated by a broken line in FIG. 10, and moves from the backward path side (the right side of the switching hook 71 in FIG. 10) to the second end side in the sheet width direction, that is, the side of the second connection path 61*e* (the left side of the switching hook 71 in FIG. 10). When the driven roller 51*b* moves to the side of the second connection path 61*e*, the switching hook 71 is separated from the driven roller 51*b* and returned by the urging member to the initial position, that is, the position indicated by the solid line in FIG. 10. At this time, the first detector 101 is turned on, thus detecting that the cutter holder 51 is placed at the cutter home position.

Thus, the reciprocal movement of the cutter holder 51 in the sheet width direction is finished. If the rolled sheet 30 is subsequently fed, the above-described reciprocal movement is repeated.

Next, a configuration of the controller 100 is described with reference to FIG. 12.

As illustrated in FIG. 12, the first detector 101, the second detector 102, the encoder sensor 103, the recording heads 15*a*, the cap elevating unit 19*c*, the suctioning units 19*d*, the driving unit 38, the cutter-holder driving motor 57, an operation-and-display unit 105, an external device 150, and the carriage driving motor 21 are connected to the controller 100. The controller 100 includes a micro computer including, for example, a central processing unit (CPU), a random access memory (RAM), a read-only memory (ROM), and an input-output interface. In this exemplary embodiment, various motors are controlled by a single controller, that is, the controller 100. However, it is to be noted that the controller 100 may be two or more controllers to control different motors. For example, the controller 100 may include a first controller to control the recording heads 15*a*, the cap elevating unit 19*c*, the suctioning units 19*d*, the carriage driving motor 21, and the driving unit 38, and a second controller to control the cutter-holder driving motor 57. Furthermore, for example, the above-described first controller may include an image formation control unit to control the recording heads 15*a* and the carriage driving motor 21, a maintenance-and-recovery control unit to control the cap elevating unit 19*c* and the suctioning units 19*d*, and a sheet feeding control unit to control the driving unit 38.

The first detector 101 is disposed at a side of the first retracted position (left side in FIG. 13) in the cutter-holder movement range R2 to detect the cutter holder 51 at the first retracted position. The second detector 102 is disposed at a side of the second retracted position (right side in FIG. 13) in the cutter-holder movement range R2 to detect the cutter holder 51 at the second retracted position. As described above, the encoder sensor 103 is mounted at the carriage 15 to read the encoder sheet 16 to detect the main scanning position of the carriage 15. Signals representing detection results of the first detector 101, the second detector 102, and the encoder sensor 103 are input to the controller 100.

The operation-and-display unit 105 is disposed at the apparatus main unit 1*a* to receive instructions of operation requests from a user or signals indicating continuation/discontinuation of printing operation on detection of an abnormality of the cutter holder 51 and to display messages, such as error messages. In particular, the operation-and-display unit 105 displays a cutter error notice indicating a cutter error, that is, the abnormality of the cutter holder 51. The controller 100 determines based on detection results of the first detector 101 and the second detector 102 whether or not an abnormality of the cutter holder 51 has occurred. When an abnormality of the cutter holder 51 has occurred, the operation-and-display unit 105 displays the cutter error notice in response to a control signal sent from the controller 100. In this exemplary embodiment, the controller 100 and the operation-and-display unit 105 having the above-described functions serve as a notification device. Besides or instead of displaying the cutter error notice on the operation-and-display unit 105, the abnormality of the cutter holder 51 may be notified to a user by making an alert sound and/or turning on an indicator. Alternatively, besides displaying the cutter error notice on the operation-and-display unit 105, for example, the cutter error notice may be displayed on a screen of the external device 150 connected to the controller 100.

The controller 100 creates data for recording a desired image on the rolled sheet 30 in accordance with image information transferred from, e.g., the external device 150 connected to the controller 100 from the outside of the inkjet recording apparatus 1, outputs the data to the recording heads 15*a*, and controls driving of the recording heads 15*a*. The controller 100 also controls the carriage driving motor 21 and the driving unit 38, as well as the recording heads 15*a*. As described above, the controller 100 controls the recording heads 15*a*, the carriage driving motor 21, and the driving unit 38 to eject ink droplets at proper timings to record a desired image on a recording area of the rolled sheet 30.

When the controller 100 determines based on a signal input from the encoder sensor 103 that the carriage 15 is placed at the carriage home position or the maintenance ejection position, the controller 100 causes the cutter holder 51 to move to the first end in the sheet width direction along the forward path (see FIG. 4) to cut the rolled sheet 30. Thus, the rolled sheet 30 is cut by the above-described sheet cutting operation.

When the cutter holder 51 is detected by the second detector 102 after the sheet cutting operation, the controller 100 causes the cutter-holder driving motor 57 to rotate in reverse, thus moving the cutter holder 51 to the second side in the sheet width direction along the backward path with the cutter holder 51 retracted from the sheet feed path. At this time, the controller 100 controls the driving unit 38 so that the rolled sheet 30 can be fed to the downstream side in the sheet feed direction while the cutter holder 51 moves along the backward path. Thus, while the cutter holder 51 moves along the backward path, the rolled sheet 30 can be fed for, e.g., image recording.

The controller 100 determines whether or not a predetermined non-activation time of nozzles has elapsed. If the controller 100 determines that the predetermined non-activation time has elapsed, the controller 100 causes the carriage 15 to move to the maintenance ejection position and the recording heads 15*a* to perform maintenance ejection. At this time, when a position of the rolled sheet 30 at which the rolled sheet 30 is to be cut by the cutter 50 (hereinafter, sheet cut position SCP) arrives at a position of the cutter 50 at which the cutter 50 cuts the rolled sheet 30 (hereinafter, cutter position CP), the above-described maintenance ejection and sheet cutting operation can be simultaneously performed. Alternatively, for example, the maintenance ejection may be performed when the number of times nozzles are used for image recording reaches a predetermined threshold.

Under certain conditions, such as, after printing operation or at the occurrence of an abnormality of the cutter holder, the cap elevating unit 19*c* is activated to cap the nozzle faces 15*b* of the recording heads 15*a* with the caps 19*a*. With the nozzle faces 15*b* capped with the caps 19*a*, the controller 100 drives the suctioning units 19*d* to discharge ink to the caps 19*a*. The suctioning units 19*d* may be driven each time the capping operation is performed, or selectively driven based on conditions of the apparatus.

The controller 100 sets either a print continuation setting for continuing printing operation at the occurrence of an abnormality of the cutter holder or a print discontinuation setting to discontinue printing operation o at the occurrence of an abnormality of the cutter holder. The print continuation setting and print discontinuation setting are set in response to a user's input through, e.g., a touch panel or setting buttons on the operation-and-display unit 105. In this exemplary embodiment, the controller 100 and the operation-and-display unit 105 having those functions serve as a setting device.

Next, control procedures of the movement of the cutter holder 51 performed by the controller 100 and the notification of a cutter error performed at the occurrence of an abnormality of the cutter holder are described with reference to FIGS. 13 and 14.

In this exemplary embodiment, each time printing operation ends or cutting of the rolled sheet 30 starts, the carriage 15 is controlled to move to the carriage home position (indicated by the solid line in FIG. 13) and standby at the carriage home position. Such a configuration facilitates the control performed by the controller 100.

Figure 14:
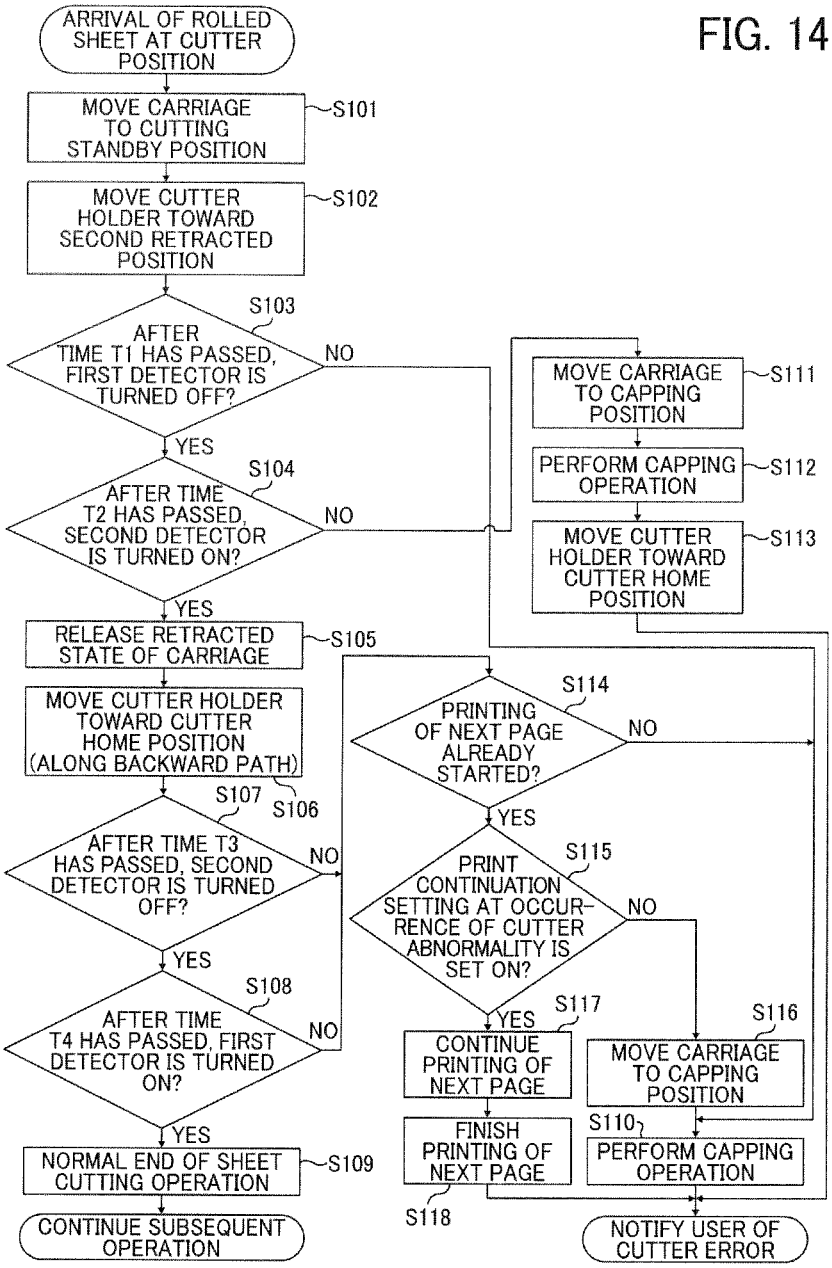
FIG. 14 is a flow chart of a control procedure performed by a controller in the first exemplary embodiment when an error of the cutter holder occurs.

As illustrated in FIG. 14, when a sheet cut position SCP of a preceding portion (hereinafter "preceding sheet") of the rolled sheet 30 arrives at the cutter position CP of the cutter 50, at S101 the controller 100 causes the carriage 15 to move to a cutting standby position (in this exemplary embodiment, the carriage home position). In other words, the carriage 15 is retracted to a position at which the carriage 15 does not interfere with the cutter holder 51, thus allowing the cutter holder 51 to move along the backward path.

At S102, the controller 100 drives the cutter-holder driving motor 57 to rotate in the normal direction. As a result, the cutter holder 51 moves along the forward path toward the second retracted position (right side in FIG. 13). Thus, the sheet cutting operation for cutting the preceding sheet from the rolled sheet 30 starts. Here, the sheet cutting operation refers to a series of operation for moving the cutter holder 51 from the cutter home position (left side in FIG. 13) to the second retracted position along the second retracted position and return the cutter holder 51 to the cutter home position along the backward path.

Below, descriptions are separately given of a case where the sheet cutting operation normally ends and a case where abnormality occurs during the sheet cutting operation.

First, the case where the sheet cutting operation normally ends is described.

At S102, the controller 100 causes the cutter holder 51 to move the cutter holder 51 toward the second retracted position. After a time T1 has elapsed, at S103 the controller 100 determines whether or not the first detector 101 is turned off. In this regard, the time T1 is set to a time (e.g., 0.3 seconds) sufficient to normally drive the cutter holder 51 and turn off the first detector 101. If the first detector 101 is turned off within the time T1 (YES at S103), at S104 the controller 100 determines whether the second detector 102 is turned on after a time T2 has elapsed. In other words, if the controller 100 determines that the cutter holder 51 has moved from the cutter home position to the rolled-sheet cutting area and has started to move on the forward path, then the controller 100 determines whether the sheet cutting operation has normally ended. In this regard, the time T2 is set to a time (e.g., 2 seconds) sufficient to move the cutter holder 51 from the cutter home position to the second retracted position in the sheet cutting operation.

If the second detector 102 is turned on after the time T2 has passed (YES at S104), at S105 the controller 100 releases the retracted state of the carriage 15. Thus, as the cutter holder 51 is retracted from the carriage movement range and the sheet feed path, the carriage 15 becomes movable and printing operation can be performed. At S106, by driving the cutter-holder driving motor 57 to rotate in reverse, the controller 100 causes the cutter holder 51 to move toward the cutter home position along the backward path with the cutter holder 51 retracted from the carriage movement range and the sheet feed path.

At S107, the controller 100 determines whether or not the second detector 102 is turned off after a time T3 has elapsed. In this regard, the time T3 may be set to a time equivalent to the time T1 (e.g., 0.3 seconds). If the second detector 102 is turned off within the time T3 (YES at S107), at S108 the controller 100 determines whether the first detector 101 is turned on after a time T4 has elapsed. In other words, if the controller 100 determines that the cutter holder 51 has started to move from the second retracted position along the backward path, then the controller 100 determines whether or not the cutter holder 51 has normally returned to the cutter home position. In this regard, the time T4 may be set to a time equivalent to the time T2 (e.g., 2 seconds).

If the first detector 101 is turned on after the time T4 has elapsed (YES at S108), at S109 the controller 100 determines that the sheet cutting operation has normally ended, and continues a subsequent operation. In other words, if printing of the next page on a subsequent portion (hereinafter, subsequent sheet) of the rolled sheet 30 following the preceding sheet is already started, the controller 100 continues the printing of the next page. When the printing of the next page ends and the sheet cut position of the next page arrives at the cutter position, the process returns to S101 and repeats the S101 and subsequent steps.

Next, the case where abnormality occurs during the sheet cutting operation.

If the first detector 101 is not turned off after the time T1 has passed (NO at S103), the controller 100 determines that the cutter holder 51 has stopped for a time longer than the time T1 (abnormality of the cutter holder), and at S110 performs capping operation to cap the nozzle faces 15*b* of the recording heads 15*a* with the caps 19*a*. Specifically, at the capping position disposed at the carriage home position, the cap elevating unit 19*c* is driven to cap the nozzle faces 15*b* with the caps 19*a*. At this time, when needed, the suctioning units 19*d* may be driven to perform cleaning operation for suctioning ink from the nozzles of the recording heads 15*a*.

After the capping operation ends, the controller 100 displays on the operation-and-display unit 105 a cutter error notice indicating the abnormality of the cutter holder.

If the second detector 102 is not turned on after the time T2 has passed (NO at S104), the controller 100 determines that the cutter holder 51 has stopped on the forward path because of a cut jam or other failure (abnormality of the cutter holder). Like the above-described S110, the controller 100 causes the carriage 15 to move to the capping position (at S111) and performs the capping operation (at S112). At S113, by driving the cutter-holder driving motor 57 to rotate in reverse, the controller 100 causes the cutter holder 51 to move toward the cutter home position. As a result, when a user accesses the interior of the inkjet recording apparatus to deal with the abnormality of the cutter holder, the user can safely remove, without touching the cutter 50, a faulty portion of the rolled sheet causing the cut jam or other failure. The above-described configuration can prevent the cutter holder 51 having stopped on the forward path from further moving in a direction in which the cutter 51 cuts the rolled sheet 30, thus minimizing the load to the cutter-holder driving motor 57.

In performing the step S113, the controller 100 preferably determines whether or not the cutter holder 51 has returned to the cutter home position, based on detection results of the first detector 101. At this time, if the cutter holder 51 has not returned to the cutter home position because of, e.g., a failure of the driving system, another error notice may be presented to the user besides or instead of the cutter error notice. It is to be noted that the above-described step S113 may not be executed. In such a case, for example, the operation-and-display unit 105 may display an alert indicating that the cutter 50 is exposed on the forward path.

After at S113 the controller 100 moves the cutter holder 51 toward the cutter home position, the controller 100 causes the operation-and-display unit 105 to display the cutter error notice thereon, thus notifying the user of the abnormality of the cutter holder 51.

If the second detector 102 is not turned off after the time T3 has passed (NO at S107), the controller 100 determines that the cutter holder 51 has stopped for a time longer than the time T3 (abnormality of the cutter holder), and at S114 determines whether or not printing of the next page is already started on the subsequent sheet of the rolled sheet 30. In this exemplary embodiment, the controller 100 performing the step S208 serves as the determination device. If the controller 100 determines that printing of the next page is not started yet (NO at S114), the above-described S110 and subsequent steps are performed.

By contrast, if the controller 100 determines that printing of the next page is already started (YES at S114), at S115 the controller 100 determines whether or not the print continuation setting for continuing printing operation at the occurrence of an abnormality of the cutter holder is set on. If the print continuation setting is set off, that is, the print discontinuation setting is set on (NO at S115), at S116 the controller 100 causes the carriage 15 to move to the capping position and performs the above-described S110 and subsequent steps. Thus, even when printing of the next page is already started at the occurrence of an abnormality of the cutter holder, the controller 100 can stop printing in response to a user's request and notify the user of the cutter error (the abnormality of the cutter holder).

By contrast, if the print continuation setting is set on (YES at S115), at S117 the controller 100 continues on-going printing of the next page. After the printing of the next page ends (S118), the controller 100 causes the operation-and-display unit 105 to display the cutter error notice thereon, thus notifying the user of the abnormality of the cutter holder 51. As described above, even when the abnormality of the cutter holder occurs, the controller 100 continues already-started printing operation and, after the end of the already-started printing operation, notifies the user of the abnormality of the cutter holder through the cutter error notice, thus preventing waste of ink.

If the first detector 101 is not turned on after the time T4 has passed (NO at S108), the controller 100 determines that the cutter holder 51 has stopped on the forward path because of, e.g., a failure of the driving system (abnormality of the cutter holder), and performs the above-described S114 and subsequent steps. In such a case, after the rolled sheet 30 is cut, the cutter holder 51 is stopped in a state in which the cutter holder is retracted from the sheet feed path and carriage movement range, thus preventing the cutter holder 51 from interfering with the carriage 15. As a result, the capping operation can be performed at S110 before notification of the cutter error (abnormality of the cutter holder).

As described above, in this exemplary embodiment, the controller 100 notifies the user of an abnormality of the cutter holder 51 based on detection results of the first detector 101 and the second detector 102. As a result, the notification timing of the cutter error varies with the position of the cutter holder 51 at the occurrence of the abnormality of the cutter holder 51. Based on the position of the cutter holder 51 and/or various operations (e.g., capping operation and printing operation) to be performed after the abnormality of the cutter holder occurs, the notification timing of the cutter error is previously programmed and stored in a read-only memory (ROM) of the controller 100 or other storage device.

As described above, the inkjet recording apparatus 1 according to this exemplary embodiment notifies the user of a cutter error (abnormality of the cutter holder 51) based on detection results of the first detector 101 and the second detector 102. As a result, the notification timing of the cutter error varies with the position of the cutter holder 51 at the occurrence of the abnormality of the cutter holder 51. For example, in a case where the cutter holder 51 is stopped at a position at which the cutter holder 51 contacts the carriage 15 (e.g., NO at S104 in FIG. 14), the controller 100 performs the capping operation on the recording heads 15*a* and notifies the user of the cutter error. Alternatively, in a case where the cutter holder 51 has stopped on the forward path and printing of the next page is already started (e.g., YES at S114 in FIG. 14), the controller 100 causes the carriage 15 to move to the carriage home position, performs the capping operation on the recording heads 15*a*, and notifies the user of the cutter error. Thus, even at the occurrence of the abnormality of the cutter holder, the capping operation can be properly performed before notification of the abnormality, thus allowing the recording heads 15*a* to be properly protected. In this exemplary embodiment, the carriage home position and the capping position of the carriage 15 are different. However, it is to be noted that the carriage home position and the capping position may be identical. In such a case, the steps S111 and S116 are not necessary.

Second Exemplary Embodiment

Figure 15:
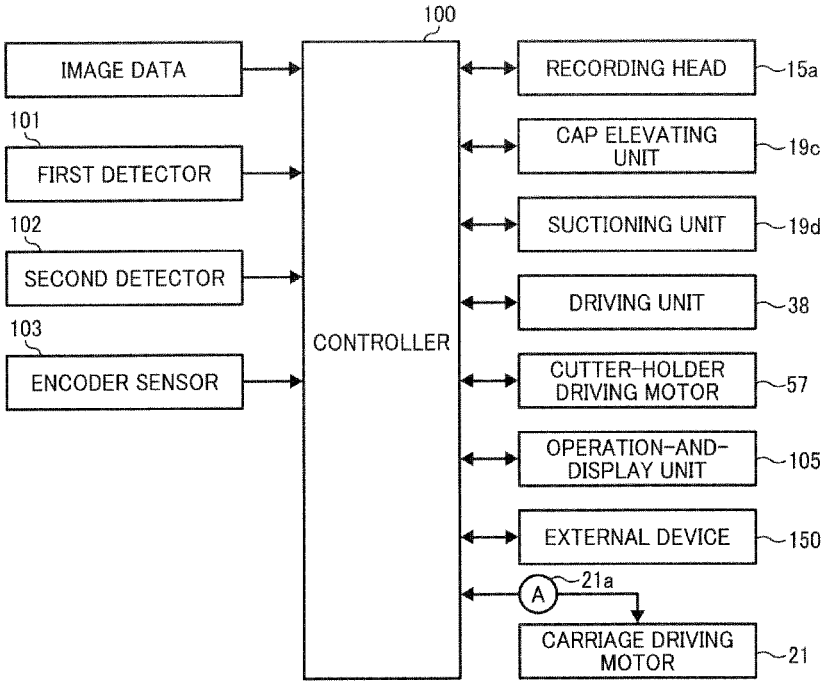
FIG. 15 is a schematic block diagram of a control configuration of an inkjet recording apparatus according to a second exemplary embodiment.

Next, an inkjet recording apparatus according to a second exemplary embodiment of this disclosure is described with reference to FIGS. 15 to 16.

In this second exemplary embodiment, the configuration of the controller and the process performed at the occurrence of an abnormality of the cutter holder partially differ from those of the first exemplary embodiment. Except for the difference, the inkjet recording apparatus according to this second exemplary embodiment has the same configuration as the inkjet recording apparatus according to the first exemplary embodiment. Therefore, the same reference codes are allocated to the same components and elements as those of the first exemplary embodiment illustrated in FIGS. 1 to 14, and features of the second exemplary embodiment differing from the first exemplary embodiment are mainly described below.

First, like the controller in the first exemplary embodiment, a controller 100 according to this second exemplary embodiment is connected to a carriage driving motor 21. The carriage driving motor 21 is connected to an ammeter 21*a* that detects a driving current of the carriage driving motor 21, and the ammeter 21*a* is connected to the controller 100 via an analog-to-digital (A/D) converter. The moving load of the carriage 15 is detected based on a current value indicating the amount of the driving current of the carriage driving motor 21 detected by the ammeter 21*a*. Thus, the controller 100 can easily obtain the moving load of the carriage 15 based on the driving current of the carriage driving motor 21. The current value of the carriage driving motor 21 is proportional to the moving load of the carriage 15, and as the current value increases, the moving load also increases. In this exemplary embodiment, the carriage driving motor 21 serves as a driving motor, and the ammeter 21*a* serves as a load detector and a current-value detector. Alternatively, the moving load of the carriage 15 may be detected based on the motor torque of the carriage driving motor 21.

The controller 100 compares the current value detected with the ammeter 21*a* with a preset threshold value. If the current value is the threshold value or more, the controller 100 stops the carriage driving motor 21. The threshold value is a current value corresponding to a load applied to the carriage driving motor 21, for example, when the carriage 15 contacts the rolled sheet after a cut jam, that is, a current value greater than a driving current in a steady state.

Next, control procedures of the movement of the cutter holder 51 performed by the controller 100 and the notification of a cutter error performed at the occurrence of the abnormality of the cutter holder are described with reference to FIGS. 13 and 16.

In this exemplary embodiment, each time printing operation ends or cutting of the rolled sheet 30 starts, the carriage 15 is controlled to move to the maintenance ejection position (indicated by the broken line in FIG. 13) and standby at the maintenance ejection position. Thus, after the end of printing operation, maintenance ejection can be performed when needed. As a result, viscosity-increased ink does not stay in the nozzles, thus preventing ink from clogging the nozzles.

Figure 16:
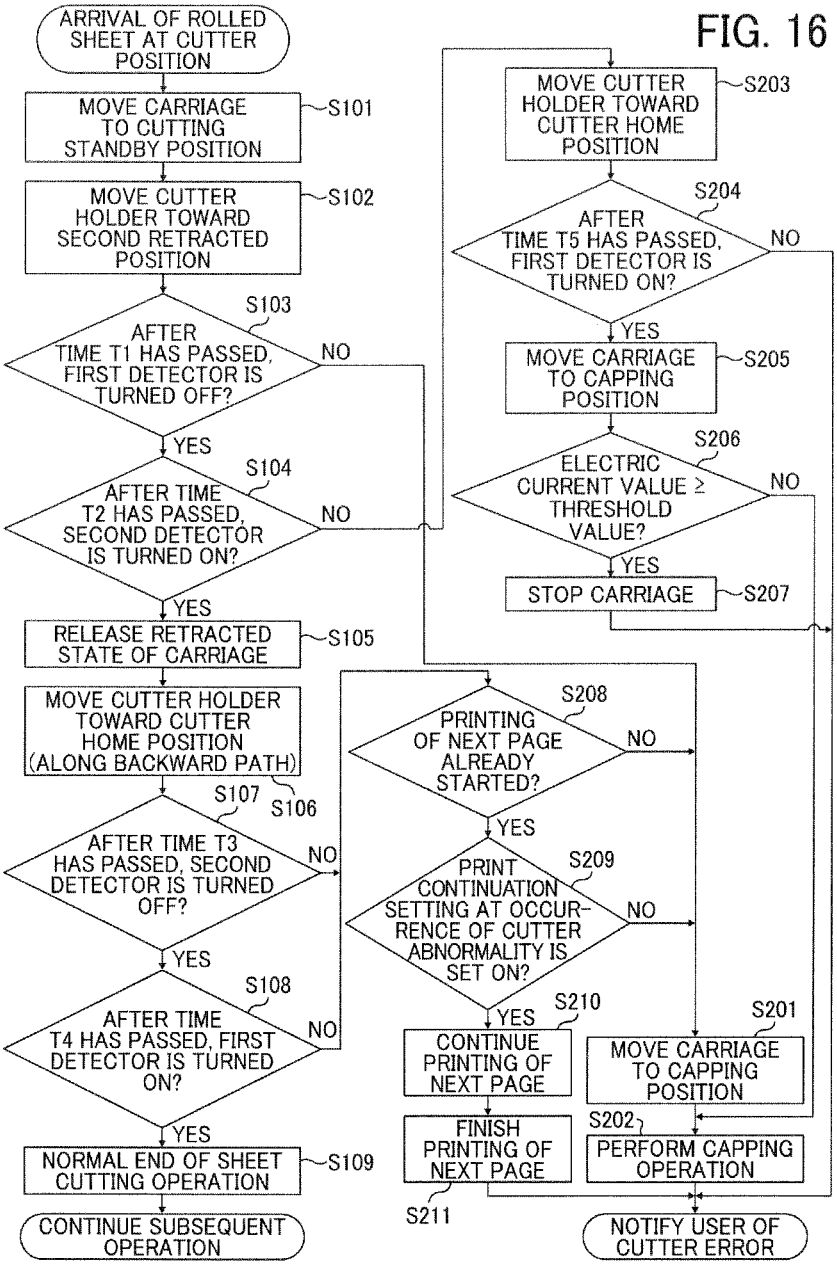
FIG. 16 is a flow chart of a control procedure performed by a controller in the second exemplary embodiment when an error of the cutter holder occurs.

Additionally, in this exemplary embodiment, steps S101 to S109 of the steps shown in FIG. 16 are identical to those of the first exemplary embodiment. Therefore, descriptions of those steps are omitted below. However, in this exemplary embodiment, the cutting standby position of the carriage 15 at S101 is set to the maintenance ejection position, which differs from that of the first exemplary embodiment. Below, steps differing from those of the first exemplary embodiment are mainly described.

As illustrated in FIG. 16, if the first detector 101 is not turned off after a time T1 has passed (NO at S103), the controller 100 determines that the cutter holder 51 has stopped for a time longer than the time T1 (abnormality of the cutter holder), and at S201 causes the carriage 15 to move from the maintenance ejection position to the capping position (indicated by the solid line in FIG. 13). At this time, because the cutter holder 51 is stopped at the cutter home position, the carriage 15 does not interfere with the cutter holder 51. At S202, the controller 100 performs capping operation for capping the nozzle faces 15*b* of the recording heads 15*a* with the caps 19*a*. Specific procedures of the capping operation are the same as those of the first exemplary embodiment. After the capping operation ends, the controller 100 causes the operation-and-display unit 105 to display thereon the cutter error notice indicating abnormality of the cutter holder 51, thus notifying a user of the abnormality of the cutter holder 51.

If the second detector 102 is not turned on after a time T2 has passed (NO at S104), the controller 100 determines that the cutter holder 51 has stopped on the forward path because of a cut jam or other failure (abnormality of the cutter holder). At S203, by driving the cutter-holder driving motor 57 to rotate in reverse, the controller 100 performs retracting operation for moving the cutter holder 51 toward the cutter home position. As a result, the cutter holder 51 moves to a position at which the cutter holder 51 does not interfere with the carriage 15. Thus, even if the carriage 15 moves, the carriage 15 does not interfere with the cutter holder 51. Additionally, when a user accesses the interior of the inkjet recording apparatus to deal with the abnormality of the cutter holder, the above-described configuration can prevent the user from accidentally contacting the cutter 50. In the above-described configuration, the cutter holder 51 stopping on the forward path is prevented from further moving in a direction in which the cutter 51 cuts the rolled sheet 30, thus minimizing the load to the cutter-holder driving motor 57.

At S204, the controller 100 determines whether or not the first detector 101 is turned on after a time T5 has elapsed. In other words, the controller 100 determines whether or not the cutter holder 51 has returned to the cutter home position. In this regard, the time T5 is set to a time (e.g., 2 seconds) sufficient to move the cutter holder 51 from a stop position on the forward path to the cutter home position.

If the first detector 101 is not turned on after the time T5 has elapsed (NO at S204), the controller 100 immediately causes the operation-and-display unit 105 to display the cutter error notice thereon to notify the user of the abnormality of the cutter holder 51, because the cutter holder 51 is probably at an immovable state due to a contact with a faulty portion of the rolled sheet having caused, for example, a cut jam. Such a configuration can prevent the cutter holder 51 from interfering with the carriage 15, thus allowing the user to be quickly prompted to deal with the abnormality of the cutter holder.

By contrast, if the first detector 101 is turned on after the time T5 has passed (YES at S204), the controller 100 determines that the cutter holder 51 is retracted to the cutter home position at which the cutter holder 51 does not contact the carriage 15, and at S205 causes the carriage 15 to move toward the capping position. The controller 100 monitors the current value of the carriage driving motor 21 with the ammeter 21*a* during movement of the carriage 15 at S205, and at S206 determines whether or not the current value is a threshold value or more. In other words, by monitoring the moving load during movement of the carriage, the controller 100 determines whether or not the carriage 15 contacts an obstacle, such as a cut-jammed portion of the rolled sheet. If the controller 100 determines that the current value of the carriage driving motor 21 is lower than the threshold value (NO at S308), the controller 100 performs the capping operation at S202 and causes the operation-and-display unit 105 to display the cutter error notice thereon, thus notifying the user of the abnormality of the cutter holder.

Alternatively, if the controller 100 determines that the current value of the carriage driving motor 21 is the threshold value or more (YES at S206), at S207 the controller 100 stops the carriage driving motor 21 to stop the carriage 15, because the carriage 15 is probably contacting an obstacle. Such a configuration can prevent the recording heads 15*a* from being damaged by a contact with an obstacle. After the carriage 15 stops, the controller 100 causes the operation-and-display unit 105 to display the cutter error notice thereon, thus notifying the user of the abnormality of the cutter holder.

Alternatively, if the second detector 102 is not turned off after a time T3 has passed (NO at S107), the controller 100 determines that the cutter holder 51 has stopped for a time longer than the time T3 (abnormality of the cutter holder), and at S208 determines whether or not printing of the next page is already started on a portion of the rolled sheet 51 (hereinafter, subsequent sheet) subsequent to the preceding portion. In this exemplary embodiment, the controller 100 performing the step S208 serves as the determination device. If the controller 100 determines that printing of the next page is not started yet (NO at S208), at S201 the controller 100 causes the carriage 15 to move to the capping position and performs the above-described S202 and subsequent steps.

By contrast, if the controller 100 determines that printing of the next page is already started (YES at S208), at S209 the controller 100 determines whether or not the print continuation setting for continuing printing operation at the occurrence of the abnormality of the cutter holder is set on. If the print continuation setting is set off, that is, the print discontinuation setting is set on (NO at S209), at S201 the controller 100 causes the carriage 15 to move to the capping position and performs the above-described S202 and subsequent steps. By contrast, if the print continuation setting is set on (YES at S209), at S210 the controller 100 continues on-going printing of the next page. After the printing of the next page ends (S211), the controller 100 causes the operation-and-display unit 105 to display the cutter error notice thereon, thus notifying the user of the abnormality of the cutter holder 51.

Alternatively, if the first detector 101 is not turned on after the time T4 has passed (NO at S108), the controller 100 determines that the cutter holder 51 has stopped on the forward path because of, e.g., a failure of the driving system (abnormality of the cutter holder), and performs the above-described S208 and subsequent steps. In such a case, after the rolled sheet 30 is cut, the cutter holder 51 is stopped in a state in which the cutter holder is retracted from the sheet feed path and carriage movement range, thus preventing the cutter holder 51 from interfering with the carriage 15. As a result, the capping operation can be performed at S202 before notification of the cutter error (abnormality of the cutter holder).

As described above, in this exemplary embodiment, the controller 100 notifies the user of an abnormality of the cutter holder 51 based on detection results of the first detector 101 and the second detector 102. As a result, the notification timing of the cutter error varies with the position of the cutter holder 51 at the occurrence of the abnormality of the cutter holder 51. Based on the positions of the cutter holder 51 and/or various operations (e.g., capping operation and printing operation) to be performed after the abnormality of the cutter holder occurs, the notification timings of cutter errors are previously programmed and stored in a read-only memory (ROM) of the controller 100 or other storage device.

As described above, in the inkjet recording apparatus 1 according to this exemplary embodiment, the controller 100 notifies the user of a cutter error (abnormality of the cutter holder 51) based on detection results of the first detector 101 and the second detector 102. As a result, the notification timing of the cutter error varies with the position of the cutter holder 51 at the occurrence of the abnormality of the cutter holder 51. For example, in a case where the cutter holder 51 is stopped at a position at which the cutter holder 51 does not contact the carriage 15 (e.g., NO at S103 in FIG. 16), the controller 100 causes the carriage 15 to move to the capping position, performs the capping operation on the recording heads 15*a*, and notifies the user of the cutter error. Alternatively, in a case where the cutter holder 51 is stopped during cutting of the rolled sheet 30 (e.g., NO at S104 in FIG. 16), the controller 100 causes the cutter holder 51 to be retracted to the cutter home position at which the cutter holder 51 does not contact the carriage, causes the carriage 15 to move to the capping position, performs the capping operation on the recording heads 15*a*, and notifies the user of the cutter error. Thus, even at the occurrence of the abnormality of the cutter holder, the capping operation can be properly performed before notification of the abnormality, thus allowing the recording heads 15*a* to be properly protected.

For example, in a case where the cutter holder 51 cannot be moved at the occurrence of the abnormality of the cutter holder (e.g., NO at S204 in FIG. 16), the controller 100 immediately notifies the user of the cutter error without performing the capping operation. Such a configuration allows the user to quickly deal with the abnormality of the cutter holder 51.

Third Exemplary Embodiment

Next, an inkjet recording apparatus according to a third exemplary embodiment of this disclosure is described with reference to FIGS. 17A and 17B.

In this third exemplary embodiment, the configuration of a controller and the process performed at the occurrence of an abnormality of a cutter holder partially differ from those of the first exemplary embodiment. Except for the difference, the inkjet recording apparatus according to this third exemplary embodiment has the same configuration as the inkjet recording apparatus according to the first exemplary embodiment. Additionally, in the third exemplary embodiment, the process performed at the occurrence of an abnormality of the cutter holder partially differs from that of the second exemplary embodiment. Except for the difference, the inkjet recording apparatus according to this third exemplary embodiment has the same configuration as the inkjet recording apparatus according to the second exemplary embodiment. Therefore, the same reference codes are allocated to the same components and elements as those of the first and second exemplary embodiments illustrated in FIGS. 1 to 16, and features of the third exemplary embodiment differing from the first and second exemplary embodiments are mainly described below.

First, like the controller in the second exemplary embodiment, a controller 100 according to this third exemplary embodiment can detect the driving current of a carriage driving motor 21 with an ammeter 21*a*. Thus, the controller 100 can detect the moving load of the carriage 15 based on the current value of the carriage driving motor 21.

Next, control procedures of the movement of the cutter holder 51 performed by the controller 100 and the notification of a cutter error performed at the occurrence of an abnormality of the cutter holder 51 are described with reference to FIGS. 13 and 17.

In this exemplary embodiment, when printing operation ends or cutting of the rolled sheet 30 starts, the carriage 15 is controlled to selectively move to either the carriage home position (indicated by the solid line in FIG. 13) or the maintenance ejection position (indicated by the broken line in FIG. 13) and standby at the position. Specifically, taking an example of control procedures performed when the rolled sheet 30 is cut, the controller 100 determines, based on an input signal from the encoder sensor 103, whether the position of the carriage 15 on arrival of the sheet cut position of the rolled sheet 30 at the cutter position of the cutter 50 is proximal to the carriage home position or the maintenance ejection position. Based on the determination result, the controller 100 causes the carriage 15 to move to a proximal one of the carriage home position and the maintenance ejection position. Such a configuration can reduce a time required for shifting the process to the sheet cutting operation, as compared to a configuration in which the carriage 15 is consistently moved to only one of the carriage home position and the maintenance ejection position.

Figures 17, 17A:
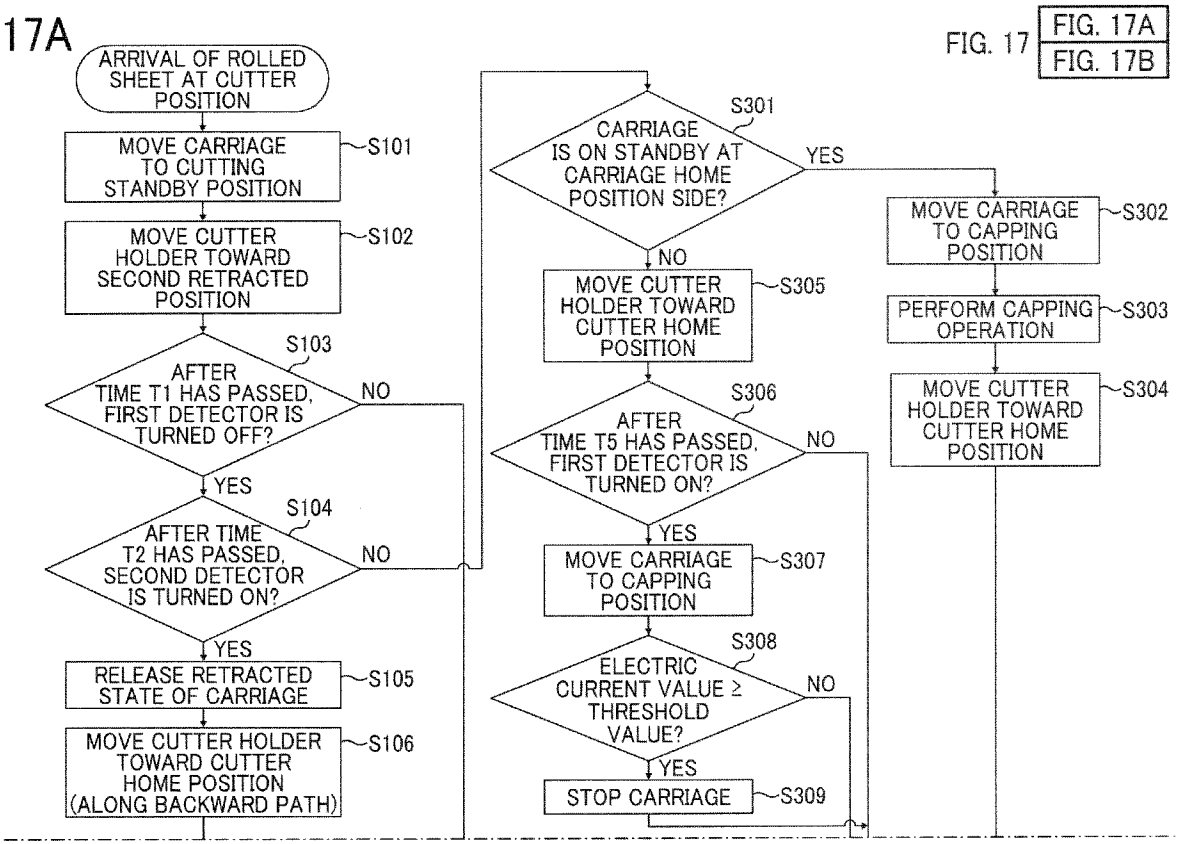
FIGS. 17A and 17B are a flow chart of a control procedure performed by a controller in an inkjet recording apparatus according to a third exemplary embodiment when an error of the cutter holder occurs.
Figure 17B:
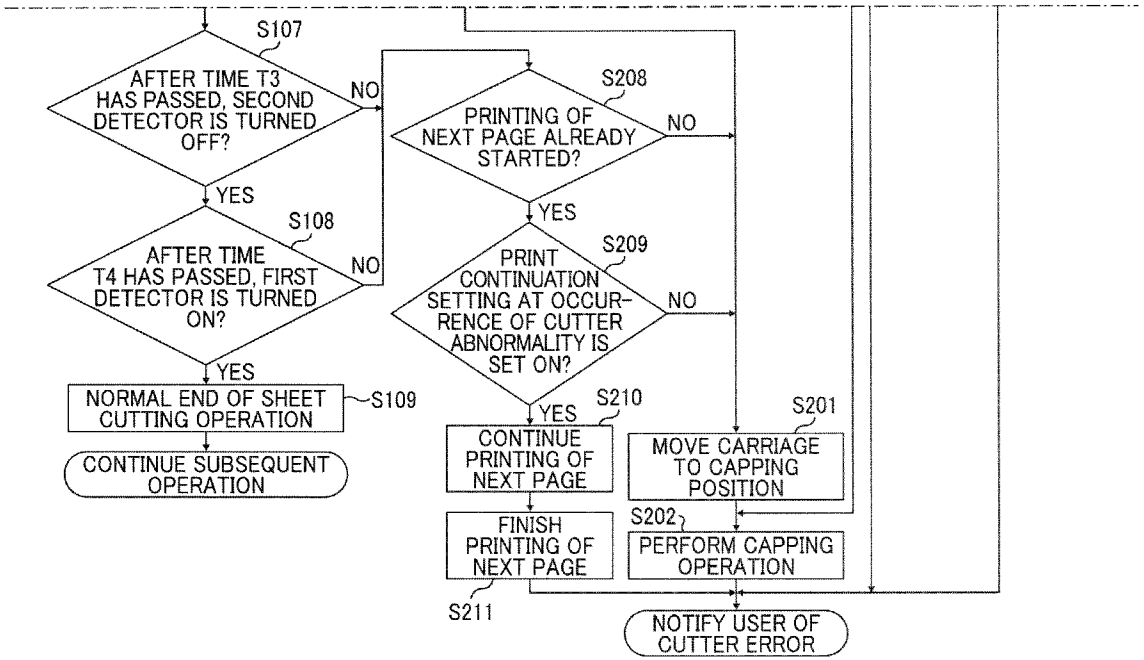

Additionally, in this exemplary embodiment, in the steps shown in FIGS. 17A and 17B, steps S101 to S109 are identical to those of the first exemplary embodiment. Additionally, steps S201, S202, and S208 to S211 in this exemplary embodiment are identical to those of the second exemplary embodiment. Therefore, descriptions of those steps are omitted below. However, in this exemplary embodiment, the cutting standby position of the carriage 15 at S101 is selectively set to either the carriage home position or the maintenance ejection position depending on the position of the carriage 15 on arrival of the sheet cut position at the cutter position, which differs from the first and second exemplary embodiments. Below, steps differing from those of the first and second exemplary embodiments are mainly described.

As illustrated in FIG. 17A, if the second detector 102 is not turned on after the time T2 has passed (NO at S104), the controller 100 determines that the cutter holder 51 has stopped on the forward path because of a cut jam or other failure (abnormality of the cutter holder), and at S301 determines whether or not the carriage 15 is on standby at the carriage home position side. In other words, the controller 100 determines whether or not the cutting standby position of the carriage 15 having moved at S101 is the carriage home position. The determination is made based on an input signal from the encoder sensor 103.

If the carriage 15 is on standby at the carriage home position side (YES at S301), at S302 the controller 100 causes the carriage 15 to move to the capping position, and at S303 performs the capping operation for capping the nozzle faces 15*b* of the recording heads 15*a* with the caps 19*a*. Specific procedures of the capping operation are the same as those of the first exemplary embodiment. Thus, even in a case where the cutter holder 51 is stopped on the forward path, when the carriage 15 is placed at the carriage home position (the capping position), the controller 100 can perform the capping operation without moving the cutter holder 51.

At S304, by driving the cutter-holder driving motor 57 to rotate in reverse, the controller 100 performs the retracting operation for moving the cutter holder 51 toward the cutter home position. As a result, when a user accesses the interior of the inkjet recording apparatus to deal with the abnormality of the cutter holder, the user can safely remove, without touching the cutter 50, a faulty portion of the rolled sheet having caused the cut jam or other failure. In performing the step S304, the controller 100 preferably determines whether or not the cutter holder 51 has returned to the cutter home position, based on detection results of the first detector 101. At this time, if the cutter holder 51 has not returned to the cutter home position because of, e.g., a failure of the driving system, another error notice is presented to the user besides or instead of the cutter error notice. It is to be noted that the above-described step S304 may not be executed. In such a case, for example, the operation-and-display unit 105 may display an alert indicating that the cutter 50 is exposed on the forward path.

After at S304 the controller 100 causes the cutter holder 51 to move toward the cutter home position, the controller 100 causes the operation-and-display unit 105 to display the cutter error notice thereon, thus notifying the user of the abnormality of the cutter holder 51.

Alternatively, if the carriage 15 is not on standby at the carriage home position side, that is, the carriage 15 is on standby at the maintenance ejection position (NO at S301), by driving the cutter-holder driving motor 57 to rotate in reverse, at S305 the controller 100 performs the retracting operation for moving the cutter holder 51 toward the cutter home position. As a result, the cutter holder 51 moves to a position at which the cutter holder 51 does not interfere with the carriage 15. Thus, even if the carriage 15 moves, the carriage 15 does not interfere with the cutter holder 51. Additionally, when a user accesses the interior of the inkjet recording apparatus to deal with the abnormality of the cutter holder, the above-described configuration can prevent the user from accidentally contacting the cutter 50. In the above-described configuration, the cutter holder 51 stopping on the forward path is prevented from further moving in a direction in which the cutter 51 cuts the rolled sheet 30, thus minimizing the load to the cutter-holder driving motor 57.

At S306, the controller 100 determines whether or not the first detector 101 is turned on after a time T6 has elapsed. In other words, the controller 100 determines whether or not the cutter holder 51 has returned to the cutter home position. In this regard, the time T6 is set to a time (e.g., 2 seconds) sufficient to move the cutter holder 51 from a stop position on the forward path to the cutter home position.

If the first detector 101 is not turned on after the time T6 has elapsed (NO at 306), the controller 100 immediately causes the operation-and-display unit 105 to display the cutter error notice thereon to notify the user of the abnormality of the cutter holder 51, because the cutter holder 51 is probably at an immovable state due to a contact with a faulty portion of the rolled sheet having caused, for example, a cut jam. Such a configuration can prevent the cutter holder 51 from interfering with the carriage 15, thus allowing the user to be quickly prompted to deal with the abnormality of the cutter holder.

By contrast, if the first detector 101 is turned on after the time T6 has passed (YES at S306), the controller 100 determines that the cutter holder 51 is retracted to the cutter home position at which the cutter holder 51 does not contact the carriage 15, and at S307 causes the carriage 15 to move toward the carriage home position. The controller 100 monitors the current value of the carriage driving motor 21 with the ammeter 21 a during movement of the carriage 15 at S307, and at S308 determines whether or not the current value is a threshold value or more. In other words, by monitoring the moving load during movement of the carriage, the controller 100 determines whether or not the carriage 15 contacts an obstacle, such as a cut-jammed portion of the rolled sheet. If the controller 100 determines that the current value of the carriage driving motor 21 is lower than the threshold value (NO at S308), the controller 100 performs the capping operation at S202 and causes the operation-and-display unit 105 to display the cutter error notice thereon, thus notifying the user of the abnormality of the cutter holder.

Alternatively, if the controller 100 determines that the current value of the carriage driving motor 21 is the threshold value or more (YES at S308), at S309 the controller 100 stops the carriage driving motor 21 to stop the carriage 15, because the carriage 15 is probably contacting an obstacle. Such a configuration can prevent the recording heads 15*a* from being damaged by a contact with an obstacle. After the carriage 15 stops, the controller 100 causes the operation-and-display unit 105 to display the cutter error notice thereon, thus notifying the user of the abnormality of the cutter holder.

As described above, in this exemplary embodiment, the controller 100 notifies the user of an abnormality of the cutter holder 51 based on detection results of the first detector 101 and the second detector 102. As a result, the notification timing of a cutter error varies with the position of the cutter holder 51 at the occurrence of the abnormality of the cutter holder 51. Based on the position of the cutter holder 51 and/or various operations (e.g., capping operation and printing operation) to be performed after the abnormality of the cutter holder occurs, the notification timing of the cutter error is previously programmed and stored in a read-only memory (ROM) of the controller 100 or other storage device.

As described above, in the inkjet recording apparatus 1 according to this exemplary embodiment, the controller 100 notifies the user of a cutter error (abnormality of the cutter holder 51) based on detection results of the first detector 101 and the second detector 102. As a result, the notification timing of the cutter error varies with the position of the cutter holder 51 at the occurrence of the abnormality of the cutter holder 51. For example, in a case where the cutter holder 51 is stopped at a position at which the cutter holder 51 does not contact the carriage 15 (e.g., NO at S103 in FIG. 17A), the controller 100 performs the capping operation on the recording heads 15*a* and notifies the user of the cutter error. Alternatively, in a case where the cutter holder 51 is stopped during cutting of the rolled sheet 30 (e.g., NO at S104 in FIG. 17A), the controller 100 determines whether the carriage 15 is stopped at the carriage home position or the maintenance ejection position, causes the cutter holder 51 to be retracted to the cutter home position at which the cutter holder 51 does not contact the carriage 15, causes the carriage 15 to move to the carriage home position (if the carriage 15 is on standby at the maintenance ejection position), performs the capping operation on the recording heads 15*a*, and notifies the user of the cutter error. Thus, even at the occurrence of the abnormality of the cutter holder, the capping operation can be properly performed before notification of the abnormality to the user, thus allowing the recording heads 15*a* to be properly protected.

For example, in a case where the cutter holder 51 cannot be moved at the occurrence of the abnormality of the cutter holder (e.g., NO at S306 in FIG. 17A), the controller 100 immediately notifies the user of the cutter error without performing the capping operation. Such a configuration allows the user to quickly deal with the abnormality of the cutter holder 51. In this exemplary embodiment, the carriage home position and the capping position of the carriage 15 are different. However, it is to be noted that the carriage home position and the capping position may be identical. In such a case, the step S302 is not necessary. Additionally, the step S201 can be skipped if the carriage 15 is placed at the carriage home position.

In each of the above-described exemplary embodiments, the cutter holder 51 has the driving roller 51*a* at the first end side in the sheet width direction and the driven roller 51*b* at the second end side in the sheet width direction. However, the configuration of the cutter holder 51 is not limited to such a configuration, and for example, the positions of the driving roller 51*a* and the driven roller 51*b* are interchangeable. In such a case, the cutter holder 51 pivots in a direction opposite the pivot direction of the cutter holder in each of the above-described exemplary embodiments. Accordingly, the arrangement of the slanted face 51*c* is modified according to the pivoting direction.

In each of the above-described exemplary embodiments, the cutter holder 51 is retracted downward in the vertical direction. Alternatively, for example, in a case in which the sheet cutting device 5 is not horizontally disposed relative to the apparatus main unit 1*a*, the cutter holder 51 may be retracted in the thickness direction of the rolled sheet 30 in accordance with the inclination of the sheet cutting device 5.

Additionally, in each of the above-described exemplary embodiments, the controller 100 controls the carriage driving motor 21 and the cutter-holder driving motor 57. Alternatively, for example, the inkjet recording apparatus may have dedicated controllers to separately control the carriage driving motor 21 and the cutter-holder driving motor 57 and another controller to generally control the dedicated controllers.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head to eject ink onto a sheet of recording media fed along a sheet feed path;

a carriage mounting the recording head and reciprocally movable in a width direction of the sheet to record an image on the sheet on the sheet feed path with the recording head, the width direction of the sheet perpendicular to a sheet feed direction in which the sheet is fed along the sheet feed path;

a sheet cutting device including a cutter to cut the sheet to a desired length and a cutter holder holding the cutter, the cutter holder movable in the width direction of the sheet, a movement area of the carriage overlapping, in a thickness direction of the sheet, a movement area of the cutter holder in which the cutter holder moves to cut the sheet with the cutter;

a cutter position detecting device to detect a position of the cutter holder; and a notification device to notify a user of an abnormality of the cutter holder, wherein the cutter holder, after cutting the sheet with the cutter, is movable in the width direction of the sheet with the cutter holder being retracted from the sheet feed path in the thickness direction of the sheet, and the notification device notifies the user of the abnormality of the cutter holder based on a detection result of the cutter position detecting device.

2. The image forming apparatus according to claim 1, further comprising a capping device to cap a nozzle face of the recording head at a capping position, wherein the capping position of the capping device is disposed at at least one of a first standby position and a second standby position of the carriage on respective ends of the movement area of the carriage, a first retracted position and a second retracted position of the cutter holder at which the cutter holder is retracted in the thickness direction of the sheet so as not to interfere with the carriage are disposed on respective ends of the movement area of the cutter holder, and during cutting of the sheet with the cutter, the cutter holder moves from the first retracted position to the second retracted position via the movement area of the cutter holder.

3. The image forming apparatus according to claim 2, wherein, when the cutter position detecting device detects that the cutter holder has stopped at one of the first and second retracted positions for a first threshold time or more, the capping device caps the nozzle face of the recording head, and the notification device notifies the user of the abnormality of the cutter holder.

4. The image forming apparatus according to claim 2, wherein the cutter position detecting device includes a first detector at a side proximal to the first retracted position to detect the cutter holder at the first retracted position and a second detector at a side proximal to the second retracted position to detect the cutter holder at the second retracted position, and when, during cutting of the sheet with the cutter, the cutter holder is not detected with the first detector and then is not detected with the second detector after a second threshold time has elapsed; the cutter holder performs a retracting operation to move to the first retracted position.

5. The image forming apparatus according to claim 4, wherein, when the cutter holder is not detected with the first detector after a third threshold time has passed since execution of the retracting operation of the cutter holder, the notification device notifies the user of the abnormality of the cutter holder.

6. The image forming apparatus according to claim 4, wherein, when the cutter holder is detected with the first detector after execution of the retracting operation of the cutter holder, the carriage moves to the capping position, the capping device caps the nozzle face of the recording head at the capping position, and the notification device notifies the user of the abnormality of the cutter holder.

7. The image forming apparatus according to claim 4, further comprising a load detector to detect a moving load during movement of the carriage to the capping position, wherein, when the moving load detected with the load detector is not smaller than a threshold value, the carriage stops and the notification device notifies the user of the abnormality of the cutter holder.

8. The image forming apparatus according to claim 7, further comprising a driving motor to move the carriage, wherein the load detector is a current-value detector to detect a driving current of the driving motor.

9. The image forming apparatus according to claim 2, wherein the capping position is disposed at the first retracted position, when a sheet cut position of the sheet arrives at a cutting position of the cutter, the carriage moves to one of the first and second retracted positions, and when, during cutting of the sheet with the cutter, the cutter holder is not detected with the first detector and then is not detected with the second detector after a second threshold time has elapsed and when the carriage is placed at the first retracted position, the capping device caps the nozzle face, and the notification device notifies the user of the abnormality of the cutter holder.

10. The image forming apparatus according to claim 9, wherein after the capping device caps the nozzle face and before the notification device notifies the user of the abnormality of the cutter holder, the cutter holder performs a retracting operation to move to the first retracted position.

11. The image forming apparatus according to claim 2, wherein the cutter position detecting device includes a first detector at a side proximal to the first retracted position to detect the cutter holder at the first retracted position and a second detector at a side proximal to the second retracted position to detect the cutter holder at the second retracted position, and when, during cutting of the sheet with the cutter, the cutter holder is not detected with the first detector and then is detected with the second detector, the carriage is movable in the width direction of the sheet.

12. The image forming apparatus according to claim 11, wherein when the cutter holder is not detected with the second detector after cutting of the sheet and then is not detected with the first detector after a fourth threshold time has elapsed, the capping device caps the nozzle face and the notification device notifies the user of the abnormality of the cutter holder.

13. The image forming apparatus according to claim 11, further comprising a determination device to determine whether, after cutting of the sheet, image recording on a subsequent sheet following the sheet is already started, wherein, during movement of the cutter holder from the second retracted position to the first retracted position after cutting of the sheet, when the cutter holder is detected with the second detector after a fifth threshold time has passed, or when the cutter holder is not detected with the second detector after the fifth threshold time and then not detected with the first detector after the fourth threshold time has passed, the determination device determines whether image recording on the subsequent sheet is already started, and in a case in which the determination device determines that image recording on the subsequent sheet is not started yet, the capping device caps the nozzle face and the notification device notifies the user of the abnormality of the cutter holder.

14. The image forming apparatus according to claim 13, further comprising:

a setting device to set, based on a user's input, a setting of whether ongoing image recording is to be continued at an occurrence of an abnormality of the cutter holder, wherein, in a case in which the determination device determines that image recording on the subsequent sheet is already started and the setting is set so as to stop ongoing image recording at an occurrence of an abnormality of the cutter holder, the carriage moves to the capping position, the capping device caps the nozzle face at the capping position, and the notification device notifies the user of the abnormality of the cutter holder.

15. The image forming apparatus according to claim 11, further comprising:

a determination device to determine whether, after cutting of the sheet, image recording on a subsequent sheet following the sheet is already started; and a setting device to set, based on a user's input, a setting of whether ongoing image recording is to be continued at an occurrence of an abnormality of the cutter holder, wherein, during movement of the cutter holder from the second retracted position to the first retracted position after cutting of the sheet, when the cutter holder is detected with the second detector after a fifth threshold time has passed, or when the cutter holder is not detected with the second detector after the fifth threshold time and then is not detected with the first detector after a fourth threshold time has passed, the determination device determines whether image recording on the subsequent sheet is already started, and in a case in which the determination device determines that image recording on the subsequent sheet is already started and the setting is set so as to continue ongoing image recording at an occurrence of an abnormality of the cutter holder, the notification device notifies the user of the abnormality of the cutter holder after the image recording on the subsequent sheet is finished.

* * * * *